US006131648A

United States Patent [19]

Rasmussen

[11] Patent Number: 6,131,648

[45] Date of Patent: Oct. 17, 2000

[54] HIGH PRESSURE CORRUGATED PLATE-TYPE HEAT EXCHANGER

[75] Inventor: Gordon Rasmussen, Jackson, N.J.

[73] Assignee: Electric Boat Corporation, Groton, Conn.

[21] Appl. No.: 09/188,741

[22] Filed: Nov. 9, 1998

[51] Int. Cl.[7] ..... F28F 3/10

[52] U.S. Cl. ..... 165/145; 165/167

[58] Field of Search ..... 165/166, 167, 165/145, 916

[56] References Cited

U.S. PATENT DOCUMENTS

| | | | |
|---|---|---|---|
| 3,865,185 | 2/1975 | Ostbo | 165/167 X |
| 4,183,403 | 1/1980 | Nicholson . | |
| 4,253,520 | 3/1981 | Friedericy et al. . | |
| 4,360,055 | 11/1982 | Frost . | |
| 4,561,494 | 12/1985 | Frost . | |
| 4,580,625 | 4/1986 | Yamanaka et al. . | |
| 4,966,231 | 10/1990 | Belcher et al. . | |
| 4,987,955 | 1/1991 | Bergqvist et al. | 165/167 |
| 5,146,980 | 9/1992 | Le Gauyer | 165/167 |
| 5,182,856 | 2/1993 | Armbruster | 165/167 X |
| 5,203,832 | 4/1993 | Beatenbough et al. . | |
| 5,228,515 | 7/1993 | Tran . | |
| 5,860,470 | 1/1999 | Andersson et al. | 165/167 X |
| 5,924,484 | 7/1999 | Andersson et al. | 165/167 |

FOREIGN PATENT DOCUMENTS

| | | | |
|---|---|---|---|
| 480404 | 3/1948 | Belgium . | |
| 916383 | 12/1946 | France | 165/167 |
| 1317666 | 1/1963 | France | 165/167 |
| 3616746 | 11/1987 | Germany . | |
| 2151347 | 7/1985 | United Kingdom . | |
| 12189 | 4/1997 | WIPO . | |

*Primary Examiner*—Leonard Leo
*Attorney, Agent, or Firm*—BakerBotts, LLP

[57] ABSTRACT

A high pressure corrugated plate-type heat exchanger includes a plate pack consisting of stacked corrugated plates having seals between adjacent plates contained in a high pressure enclosure. The seals act as the primary arrangement for containing the high pressure fluids supplied to the spaces between the plates and the high pressure enclosure provides resistance to high pressures applied to the seals from the fluids in the spaces between the plates or in port holes extending through the plates. The high pressure seals comprise either a captive O-ring type seal or a welded joint between the plates, or combinations of both types of seal. In one embodiment, a compression block is inserted between the plate pack and the end of the high pressure enclosure to transfer pressure from the end of the enclosure to the plates of the plate pack and thereby compress resilient seals disposed between the plates to a desired degree. The plate packs may have rectangular plates, circular plates, oval plates or rectangular plates with curved edges.

14 Claims, 22 Drawing Sheets

HIGH PRESSURE CORRUGATED PLATE-TYPE HEAT EXCHANGER

BACKGROUND OF THE INVENTION

This invention relates to heat exchangers of the type generally known as plate-type heat exchangers having corrugated plates and arranged to conduct fluids under high pressure in heat exchange relation.

Corrugated plate-type heat exchangers have been used for many applications. Typical corrugated plate-type and similar heat exchangers are disclosed in U.S. Pat. Nos. 4,983,403; 4,360,055; 4,561,494; 4,580,625 and 5,228,515.

Such heat exchangers require only a few main parts, i.e., corrugated plates, gaskets, a stationary end plate, a movable end plate, fasteners, and inlet and outlet nozzles. In these heat exchangers, a series of gasketed metal plates, which are corrugated or embossed, are clamped together between the two end plates so that the corrugations in the plates form channels through which hot or cold fluids flow, the hot fluid being on one side of each plate and the cold fluid on the other side, with each plate acting as the heat transfer element. The gaskets are disposed at the outer peripheries of the plates and are compressed between the plates to prevent external leakage. Such corrugated plate-type heat exchangers provide significant advantages in terms of reduced cost, weight, space, thermal efficiency and the like in comparison to conventional shell and tube heat exchangers. Conventional corrugated plate-type heat exchangers, however, can only handle heat exchange fluids having a pressure up to about 400 pounds per square inch because the gaskets tend to be forced out of their locating grooves at higher pressures, causing severe leakage.

SUMMARY OF THE INVENTION

Accordingly, it is an object of the present invention to provide a corrugated plate-type heat exchanger capable of operating at very high fluid pressures.

Another object of the invention is to provide a corrugated plate-type heat exchanger in which gaskets are prevented from being forced out of their gasketing positions at high pressures.

These and other objects of the invention are attained by providing a corrugated plate-type heat exchanger and a high pressure enclosure which encloses the corrugated plate-type heat exchanger and provides an external pressure boundary which counteracts any tendency toward displacement of gasketing caused by high internal fluid pressures in the heat exchanger. In addition to maintaining the integrity of the seals used in the corrugated plate-type heat exchanger, the enclosure also contains any leakage which might occur, thereby preventing harm or damage to personnel or equipment in the region of the heat exchanger.

In one embodiment, the corrugated plate-type heat exchanger has plates which are welded together to form peripheral seals thereby avoiding the need for gasketing between the plates and, in another embodiment, resilient seals are provided with spacer pieces to capture them in position and to transfer pressure between the seals and the high pressure fluids or the surrounding high pressure enclosure.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
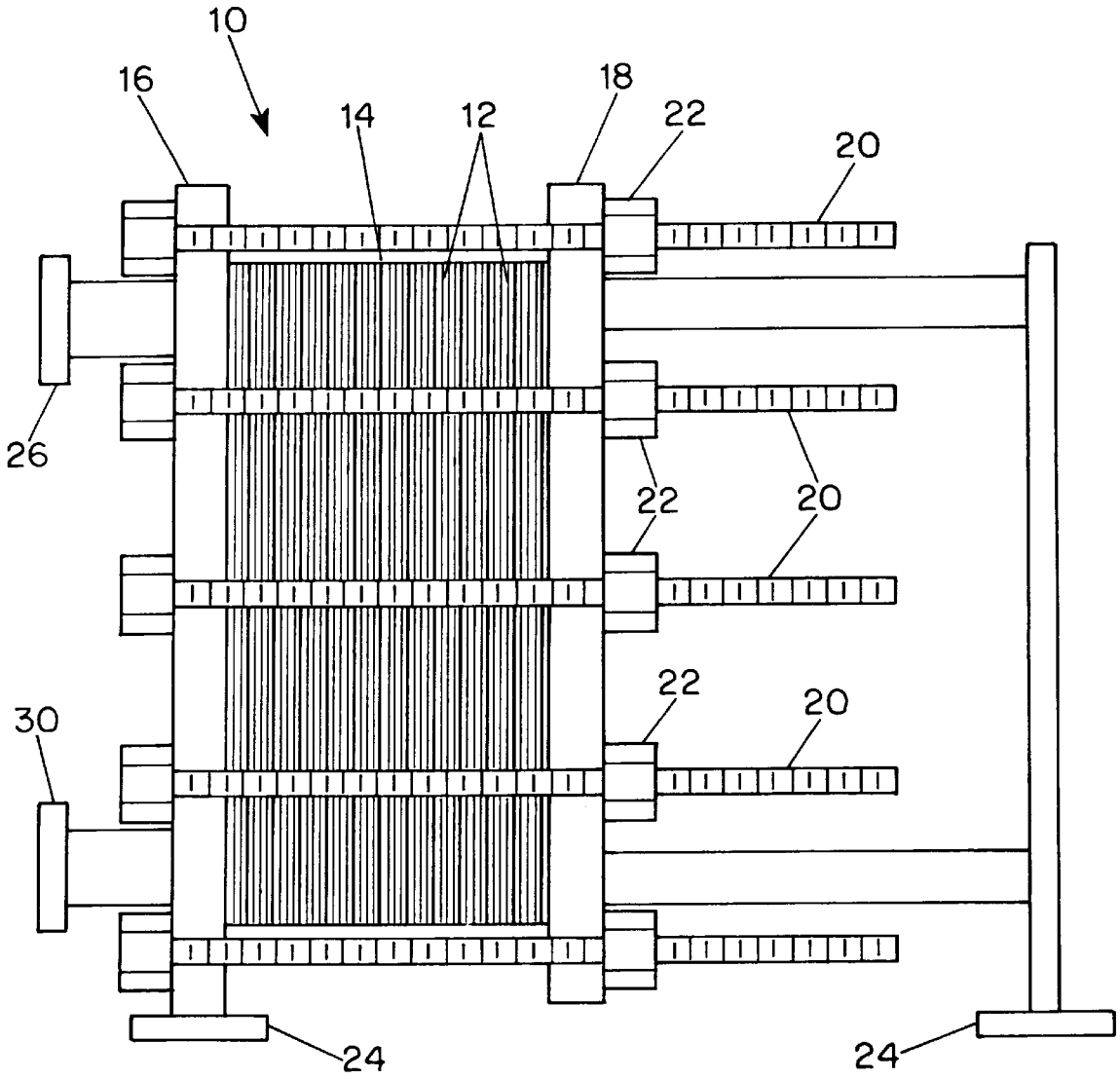
FIG. 1 PRIOR ART
FIG. 1 is a side view showing a conventional corrugated plate heat exchanger in the assembled condition.
Figure 2:
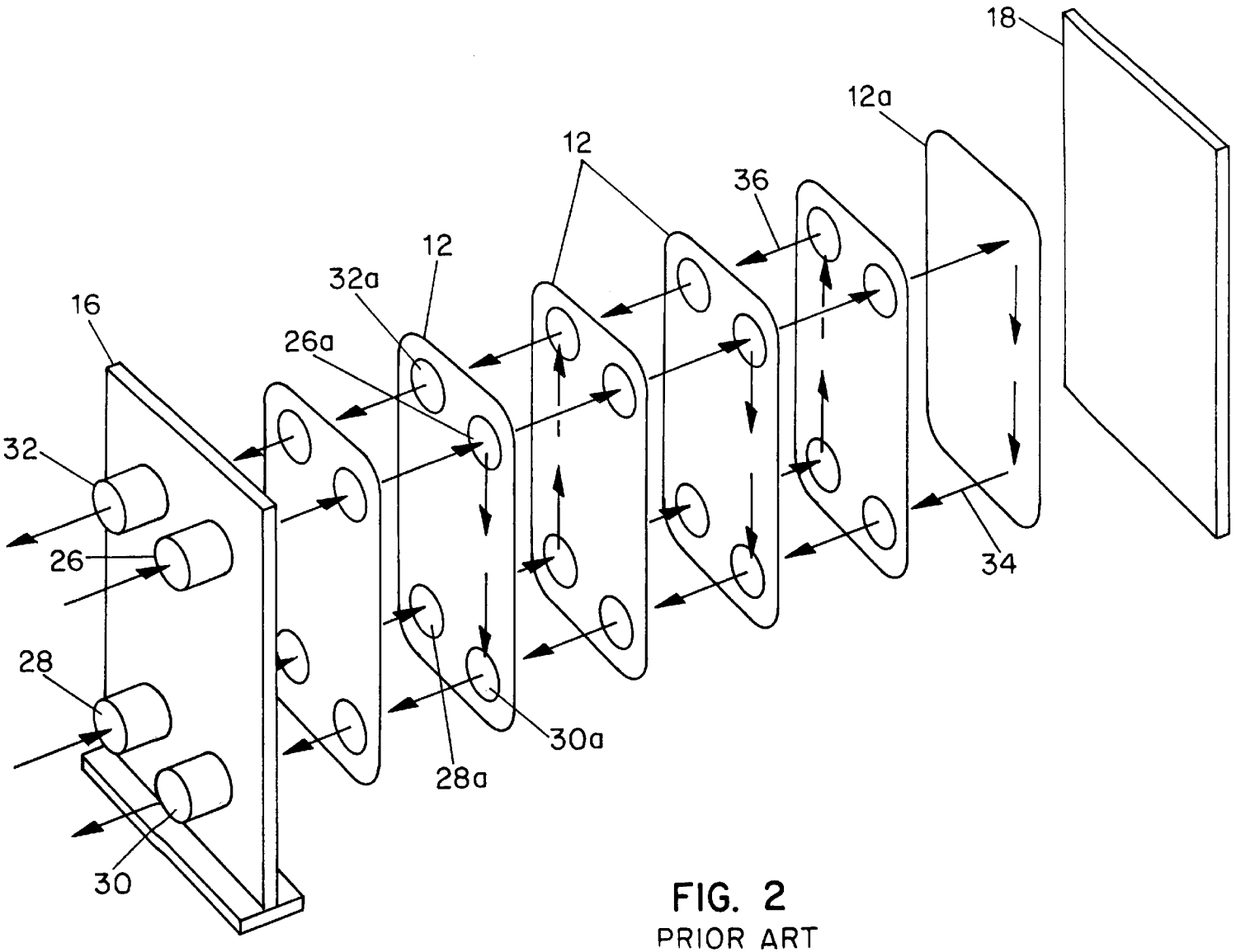
FIG. 2 PRIOR ART
FIG. 2 is an exploded view showing the internal components of the heat exchanger of FIG. 1.
Figure 3:
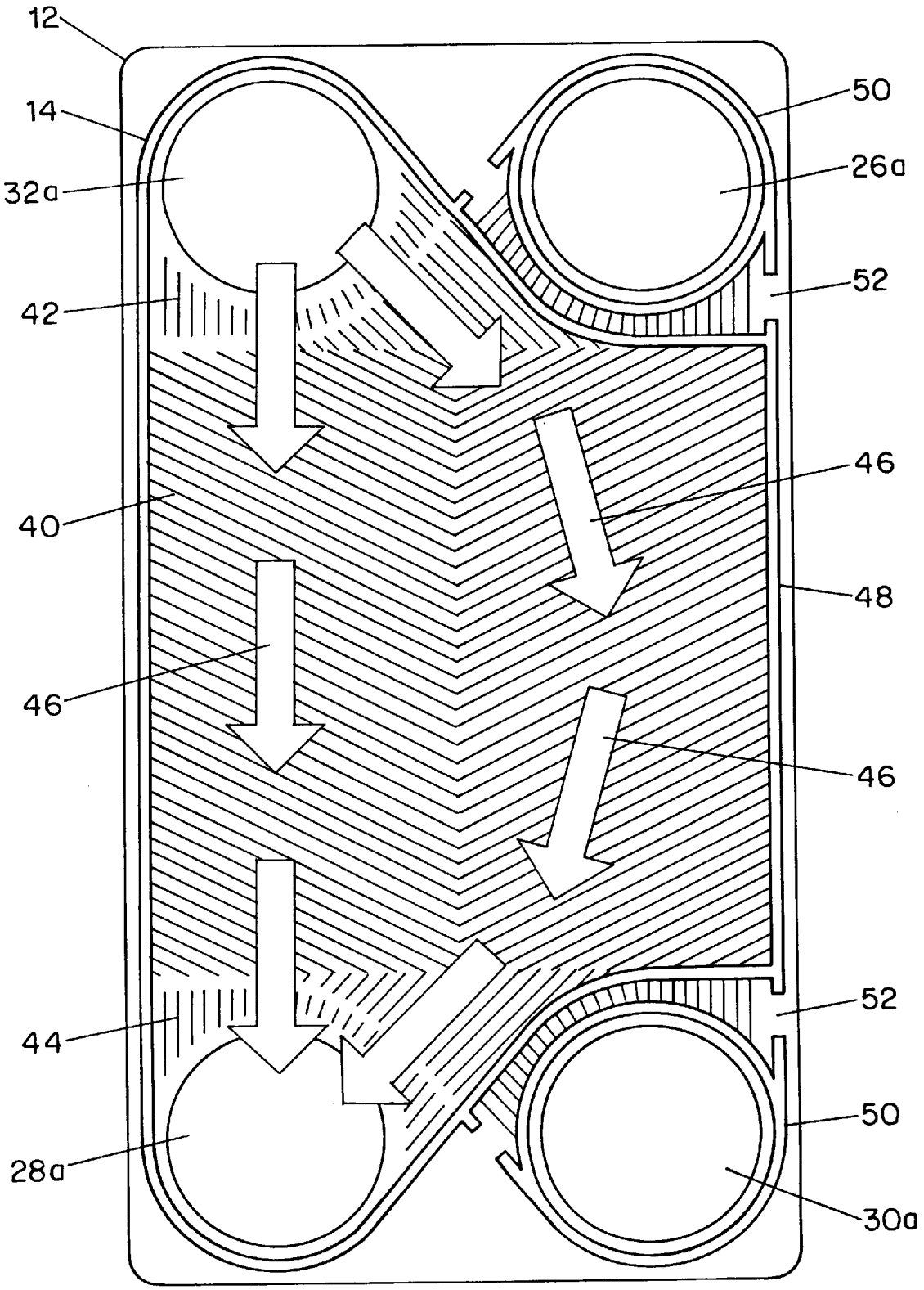
FIG. 3 PRIOR ART
FIG. 3 is a plan view showing a representative corrugated plate for a conventional heat exchanger.

In the typical conventional corrugated plate-type heat exchanger shown in FIGS. 1–3 a plate pack 10 consisting of an array of corrugated plates 12 provided with intervening gasketing 14 is compressed between a stationary end plate 16 and a movable end plate 18 by compression bolts 20 and corresponding nuts 22, the assembly being supported on feet 24. In the illustrated arrangement, the stationary end plate 16 is provided with four nozzles including two inlet nozzles 26 and 28 and two outlet nozzles 30 and 32 which communicate respectively with two internal passages 34 and 36 in the heat exchanger through which hot and cold fluids are conveyed.

As best seen in FIGS. 2 and 3, the gasketing 14 between adjacent plates 12 is arranged so that the fluid received at one inlet nozzle 26 is conveyed to the passage 34 which directs fluid between alternate pairs of plates and to a corresponding outlet nozzle 30 and the other inlet nozzle 28 is connected to the passage 36 which directs fluid through the other spaces between the pairs of corrugated plates to a corresponding outlet nozzle 32. As indicated in FIG. 2, each of the plates 12, except for the last plate 12*a*, has four inlet and outlet ports 26*a*, 28*a*, 30*a* and 32*a* aligned with the nozzles 26, 28, 30 and 32, respectively, to form the passages 34 and 36 leading from the inlet nozzles 26 and 28 to the outlet nozzles 30 and 32, respectively. The end plate 12*a* has no ports and therefore directs the fluid from the last plate port 26*a* to the last plate port 30*a* and back to the nozzle 30. The flow path 36 is diverted from the last port 28*a* to the last port 32*a* by the gasketing arrangement described hereinafter.

As shown in FIG. 3, each plate 12 includes a central portion 40 having a herringbone corrugated pattern and portions 42 and 44 adjacent to each inlet and outlet opening, respectively, having corrugations which are shaped to direct the flow of fluid so that it is distributed over the entire central corrugated pattern 40 in the manner indicated by the arrows 46 in FIG. 3. In addition, the gasketing 14 between each pair of adjacent plates 12 includes a main gasket 48 surrounding a plate region which includes one inlet port and one outlet port and the entire central corrugated pattern 40 as well as the corrugations between the central pattern 40 and the inlet and outlet opening enclosed by the gasket. In the case shown in FIG. 3, the main gasket 48 encloses the inlet port 32*a* and the outlet port 28*a* as well as the corrugated patterns. Each of the main gaskets is in the form of a continuous loop or O-ring shaped to enclose the desired portion of the space between adjacent plates 12.

In addition, the gasketing in the space between adjacent plates includes two port-hole O-rings 50 surrounding the other inlet and outlet openings 26*a* and 30*a* so as to direct fluid between those port holes and the corresponding port holes in the plate adjacent to the illustrated plate without permitting any flow of that fluid into the remainder of the space between the adjacent plates. The port hole gaskets 50 are spaced from the main gasket 48 by bleed passages 52 to equalize the pressure in the spaces between the port hole gaskets and the main gasket. The corrugations in the central region 40 of each plate are arranged in a herringbone pattern to assure turbulent flow of the fluid passing through that region and therefore provide maximum heat exchange between the fluids passing on opposite sides of the plates. Moreover, the direction of the herringbone pattern is reversed from plate to plate and the height of the plate corrugations is selected so that, when the plates of the heat exchanger plate pack 10 are forced together by tightening the nuts 22 to move the end plate 18 toward the stationary plate 16 sufficiently to compress the gasketing 14 by a specific amount such as, for example, 25%, the high points of the corrugations in each plate touch the high points of the corrugations in adjacent plates.

Gasketing arranged in the foregoing manner is usually effective to contain heat exchange fluids passing through the heat exchanger at pressures of no more than about 400 psi. At higher pressures, the gasketing will be displaced by the internal fluid pressures sufficiently to permit the fluid to escape, which could result in a high pressure spray of the heat exchange fluid into the surrounding environment and endanger personnel and equipment in that region. If attempts are made to resist high fluid pressure by providing gasketing having a greater thickness and applying a higher gasket compression force, however, non-uniformities in the degree of gasketing compression may be produced and the desired touching contact between adjacent corrugated plates may not be achieved.

One embodiment of a heat exchanger 60 arranged to overcome this problem in accordance with the invention, is shown in FIGS. 4–7. Referring first to FIGS. 5A–5C and 6, this heat exchanger arrangement includes a plate pack 62 enclosed in high pressure enclosure consisting of a hollow shell 64 having two inlet nozzles 66 and 70 and two outlet nozzles 68 and 72 and an end plate 74 retained against the open end of the shell 64 by an array of closely spaced bolts 76 and nuts 78. In the assembled condition shown in FIG. 6, the end plate 74 compresses an O-ring gasket 80 which is held captive in a recess 82 surrounding the opening in the hollow shell 64. Within the opening formed by the shell 64, a compression block 84 made of a resilient material is disposed between the end plate 74 and the plate pack 62 to transfer the pressure applied by the end plate 74 uniformly to the plate pack. Each of the inlet and outlet nozzles 66, 68, 70 and 72 communicates with corresponding inlet and outlet port holes 66*a*, 68*a*, 70*a* and 72*a*, in each plate shown in FIG. 8, in the manner described above in connection with FIGS. 1–3. The plates 86 of the plate pack 62 have corrugated patterns 87 similar to those of the conventional corrugated plate-type heat exchanger described above with respect to FIGS. 1–3 and heat is transferred through the plates from one medium to other in the same manner but the thickness of the plates may be greater, if necessary, to withstand higher pressures.

Figure 4:
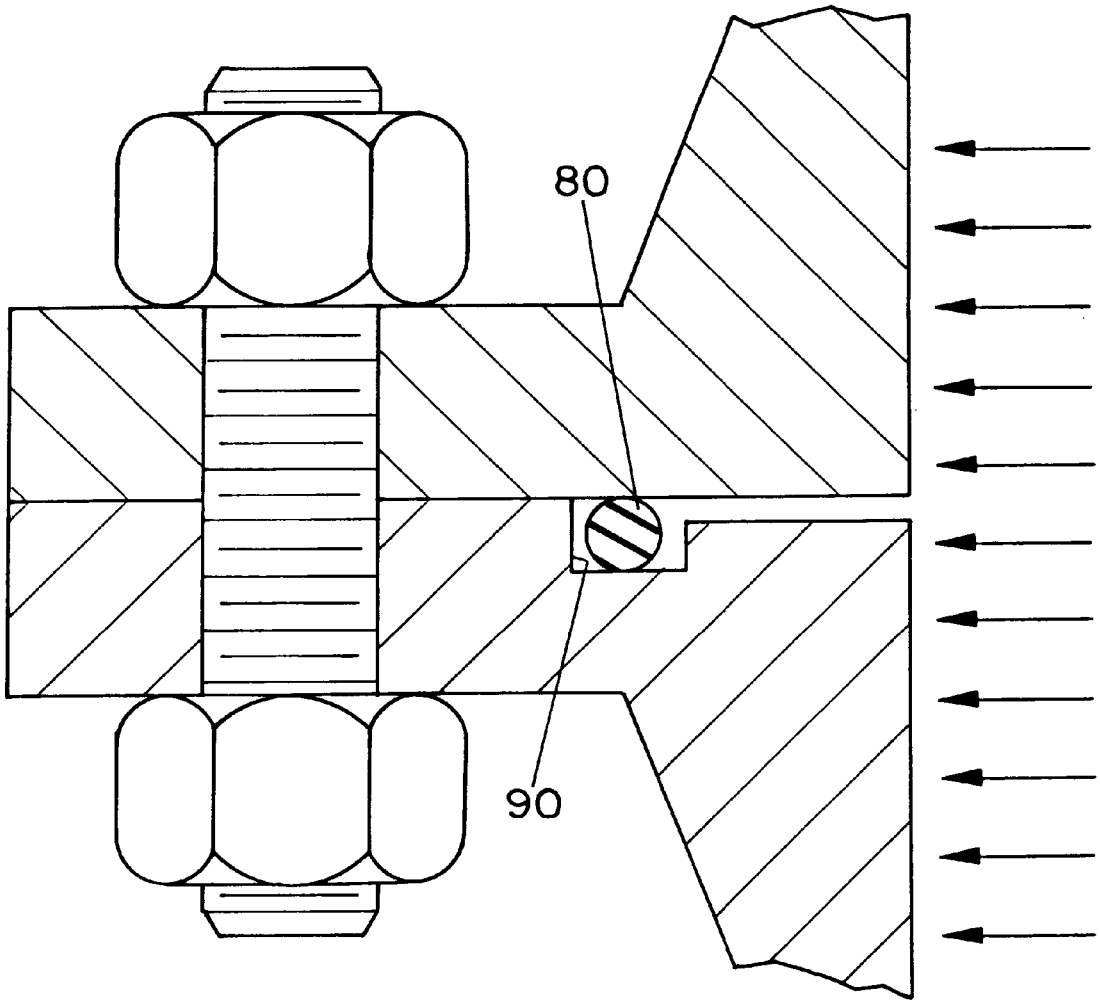
FIG. 4 is a fragmentary cross-sectional view illustrating the arrangement of a captured O-ring joint used in the heat exchanger arrangement of FIG. 6.
Figure 5A:
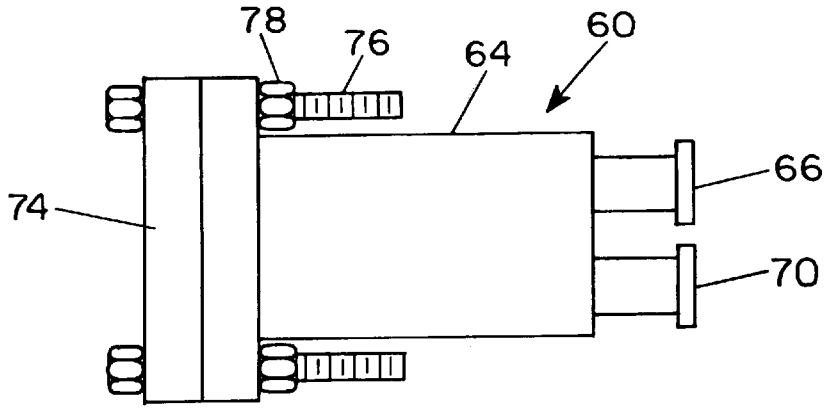
FIGS. 5A–5C are plan, elevation and end views, respectively, of a representative embodiment of a high pressure heat exchanger arranged in accordance with the invention.
Figure 5B:
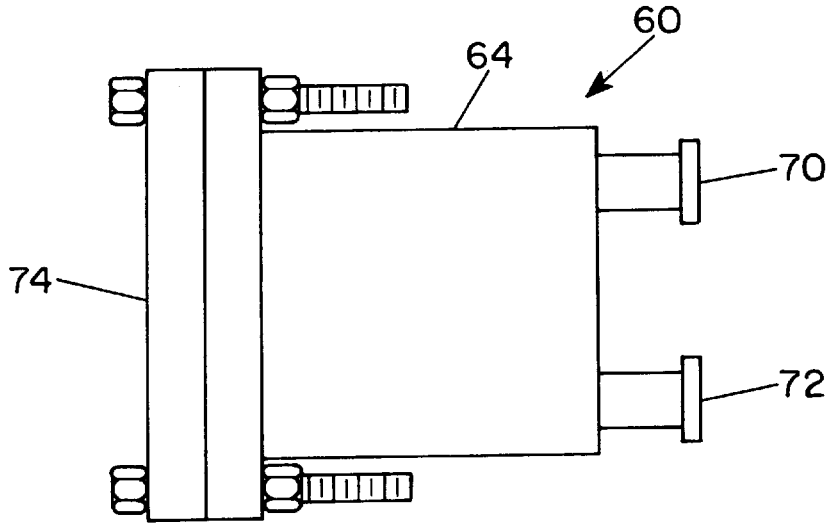
Figure 5C:
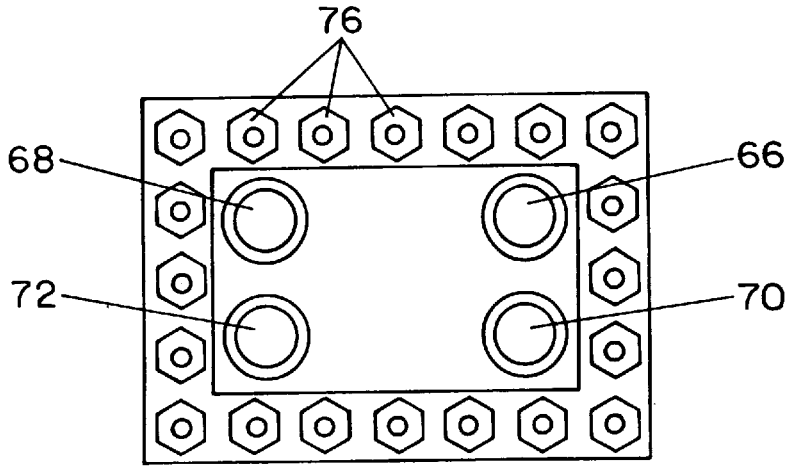
Figure 6:
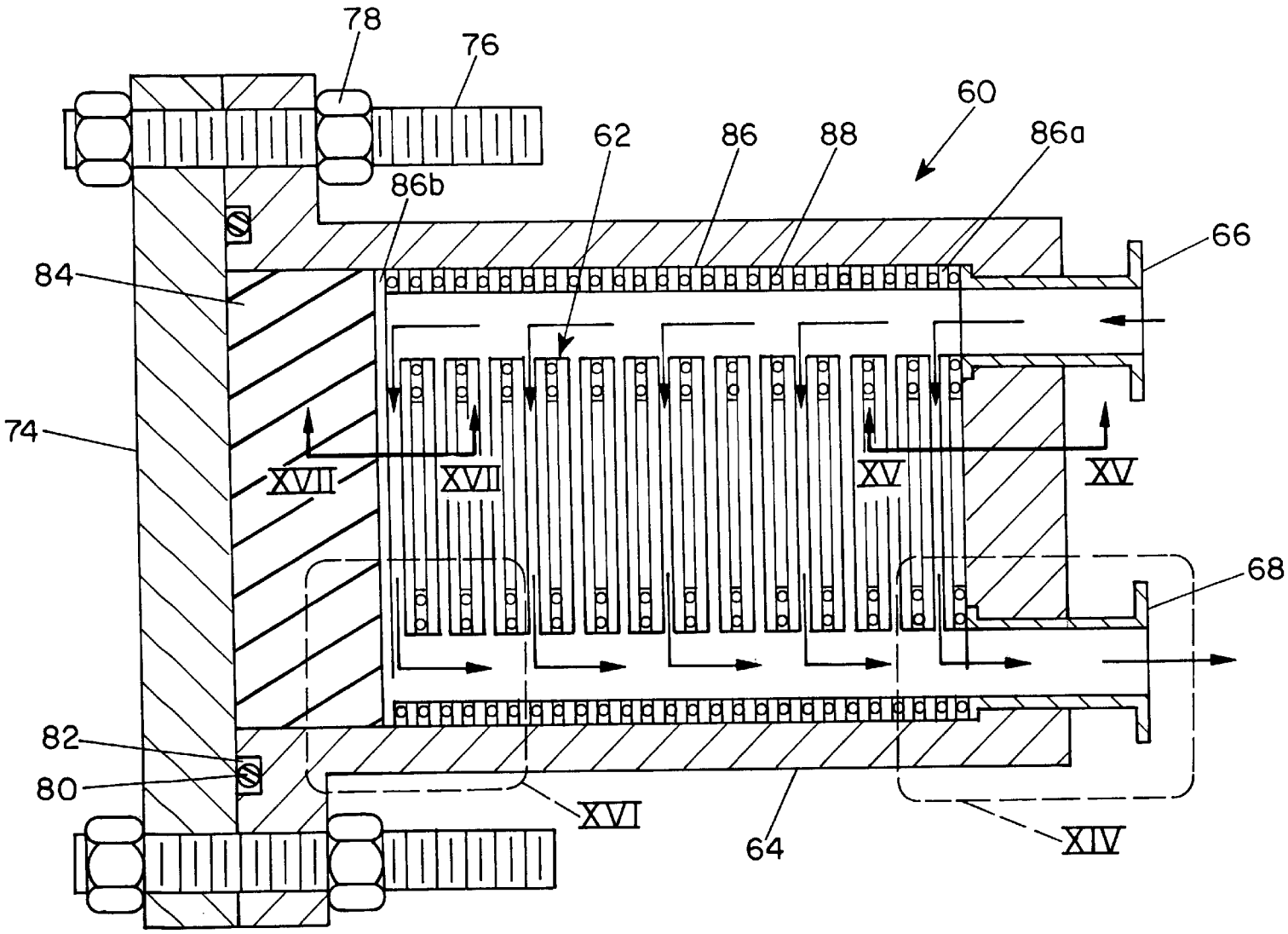
FIG. 6 is a cross-sectional view showing the interior of a representative embodiment of a high pressure heat exchanger in accordance with the invention in the fully assembled condition.
Figure 7:
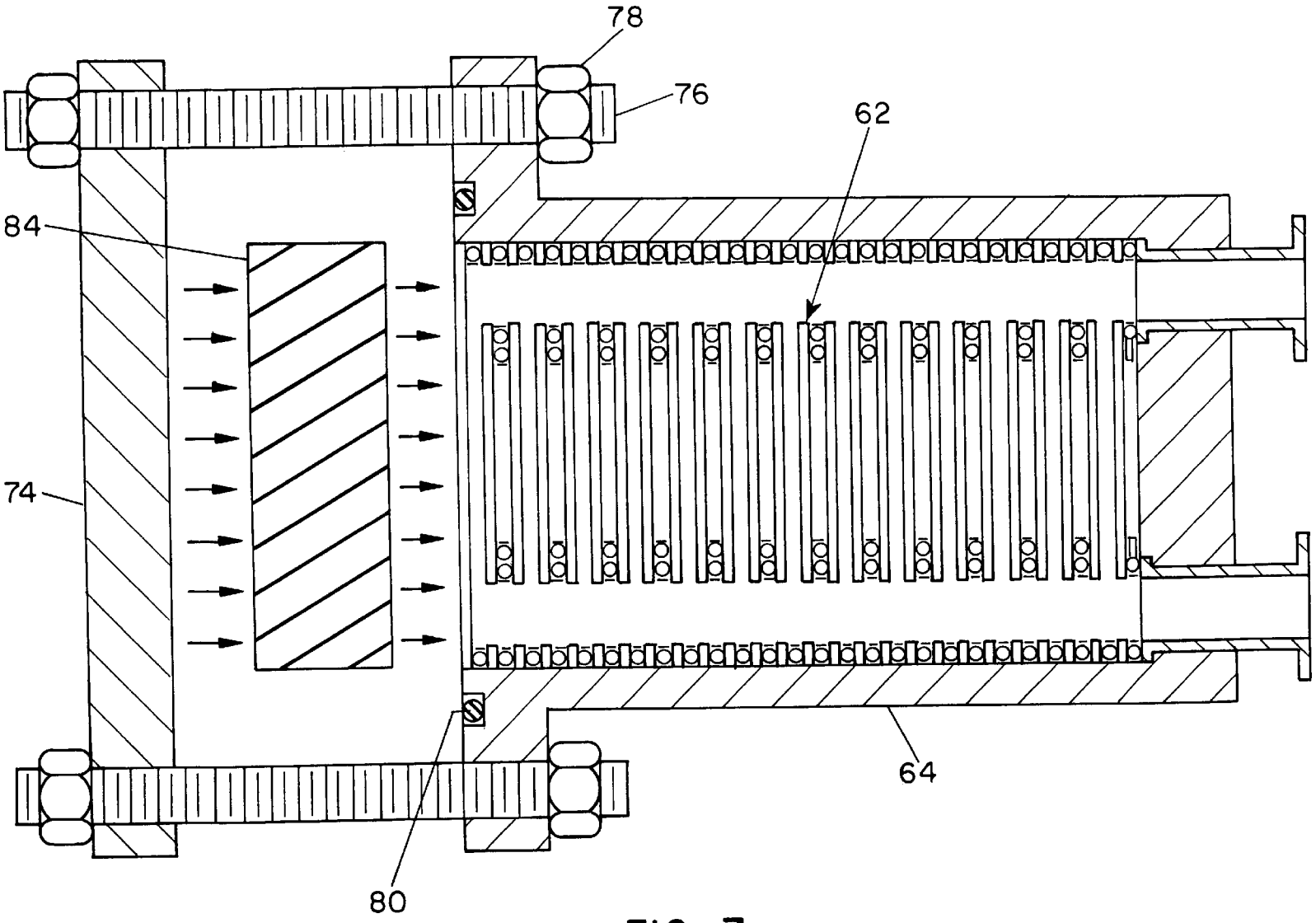
FIG. 7 is a cross-sectional view showing the heat exchanger of FIG. 6 prior to compression of the O-ring seals used in the assembly.

During assembly the plates 86 of the plate pack 62 together with gasketing 88 between the plates are inserted in the hollow shell 64 and, in the initially assembled condition, the pack has a length approximately equal to the depth of the opening in the shell 64 as shown in FIG. 7. The compression block 84 is placed on top of the assembled plate pack and the cover 74 is installed. As the nuts 78 are tightened on the bolts 76, the compression block 84 and plate pack 62 are compressed as shown by the arrows in FIG. 7 so as to fit within the opening in shell 64 while deforming the gasketing 88 to a desired degree, such as about 25%, to provide hydraulic fluid tightness and assure that the plates 86 touch each other at the high points of the plate corrugations. In addition, as shown in FIG. 4, the cover gasket 80 is compressed in the recess 82 surrounding the opening in the hollow shell 64 to provide a high pressure seal. When the gasket 80 is subjected to the internal pressure within the high pressure enclosure it is forced against the outer surface 90 of the recess 82, assuring an effective seal against leakage of internal fluids at pressures up to, for example, 1200 psi or more.

Figure 8:
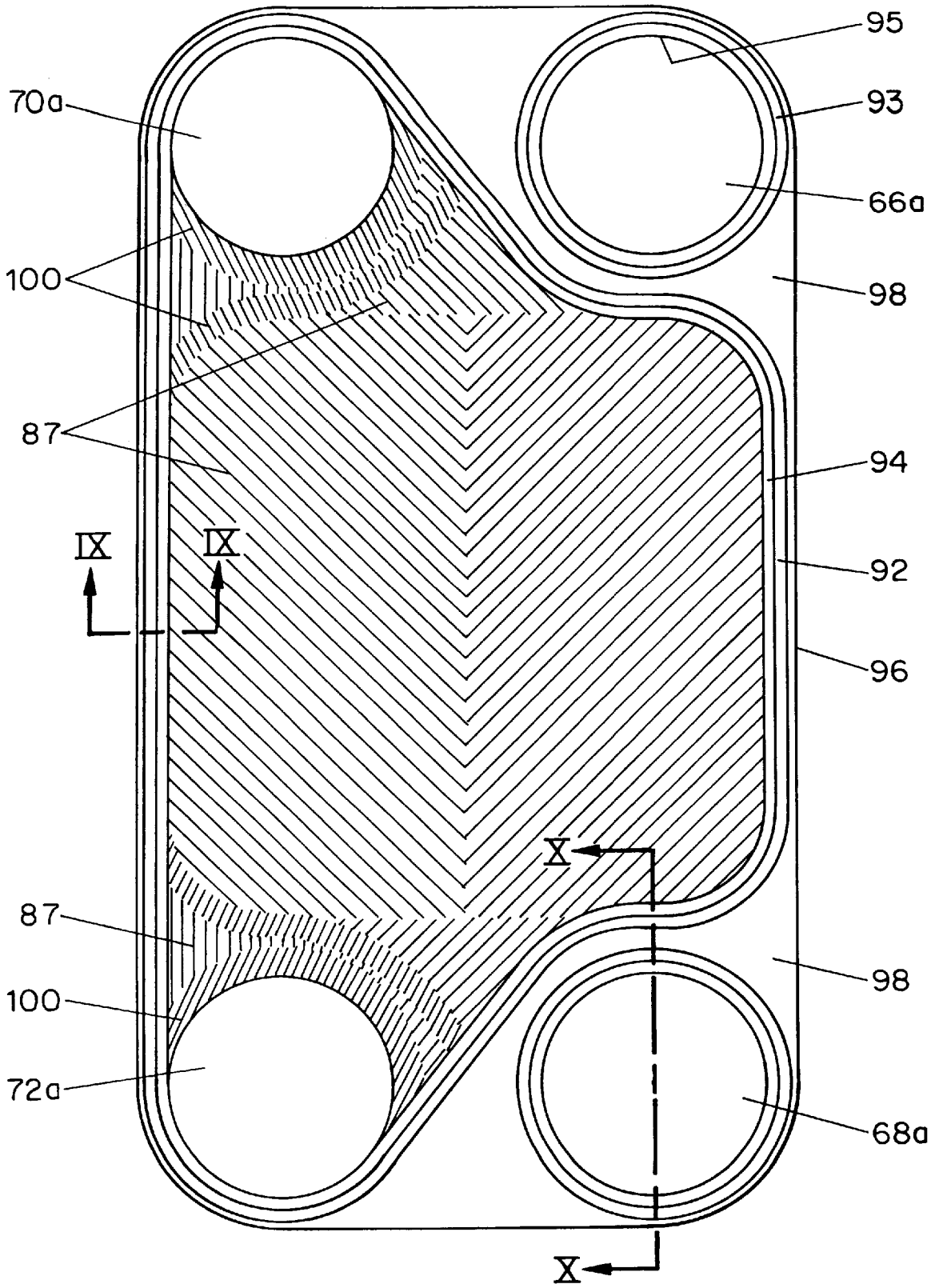
FIG. 8 is a plan view of a representative heat transfer plate provided with O-ring seals for use in the high pressure heat exchanger of FIGS. 5A–7.
Figure 9:
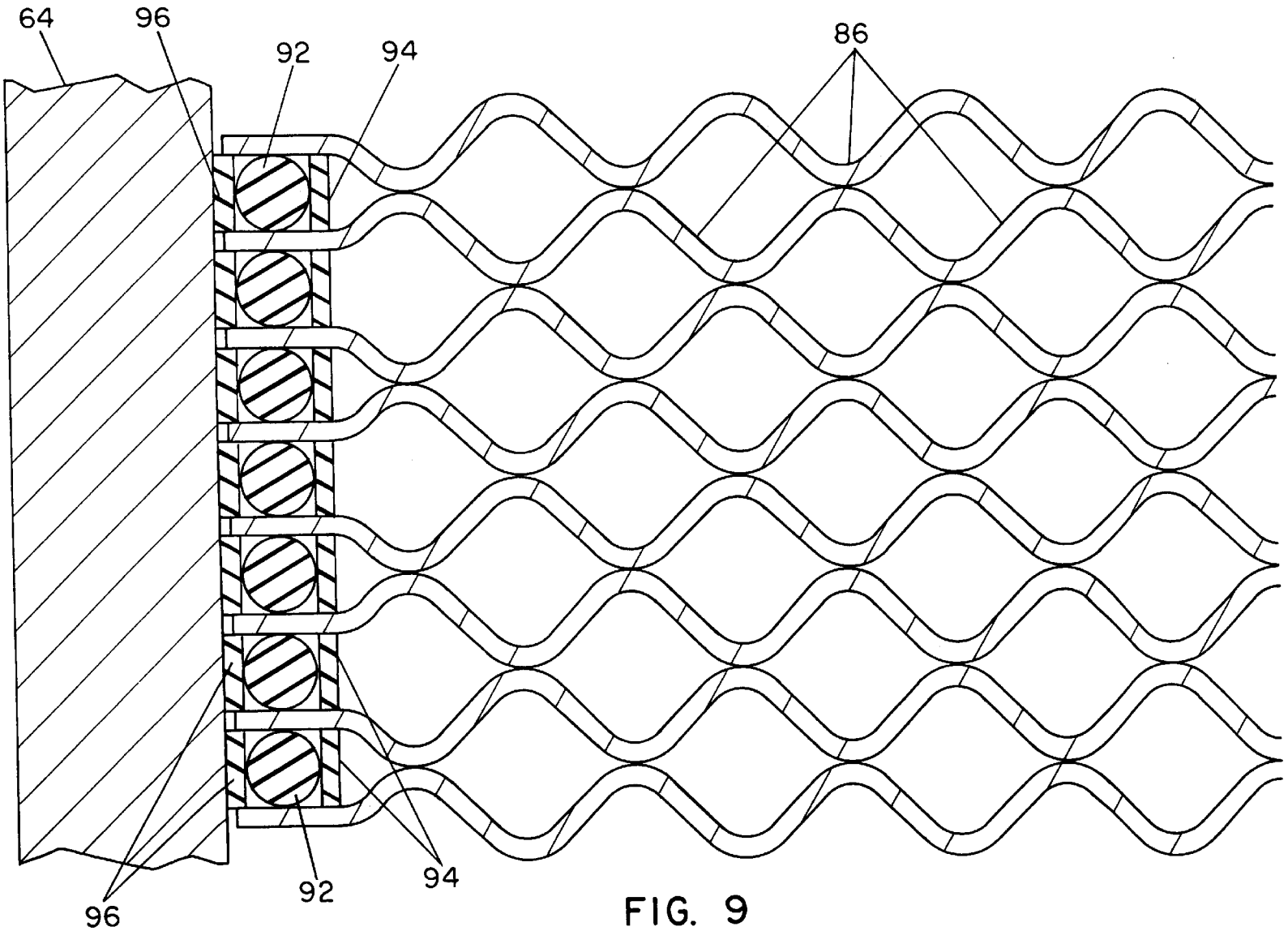
FIG. 9 is an enlarged fragmentary cross-sectional view taken on the line IX—IX of FIG. 8 and looking in the direction of the arrows.

In order to retain the gasketing 88 in place when such high pressures are applied, the gaskets 88 between each pair of adjacent plates includes a main seal 92, an inner spacer piece 94 and an outer spacer piece 96 as shown in FIG. 9. Each of the main seal, inner spacer piece and outer spacer piece is in the form of a continuous loop as shown in FIG. 8, but the inner and outer spacer pieces are made of a material which is more rigid than the main seal and have a height which is equal to the desired height of the main seal after it has been compressed, so that the inner and outer spacer pieces arc held in position by the adjacent plates. In this way the main seal is captured between the inner and outer spacer pieces so as to be maintained in the correct position and avoid displacement or extrusion when high fluid pressures are applied. If desired, grooves (not shown) may be formed in the surfaces of the plates 86 along the paths of the inner and outer seal spacer pieces 94 and 96 to make certain that they remain in position when high fluid pressures are applied. The inner and outer spacer pieces 94 and 96 also prevent direct contact between the heat exchange media and the main seal and prevent abrasion of the main seal.

Figure 10:
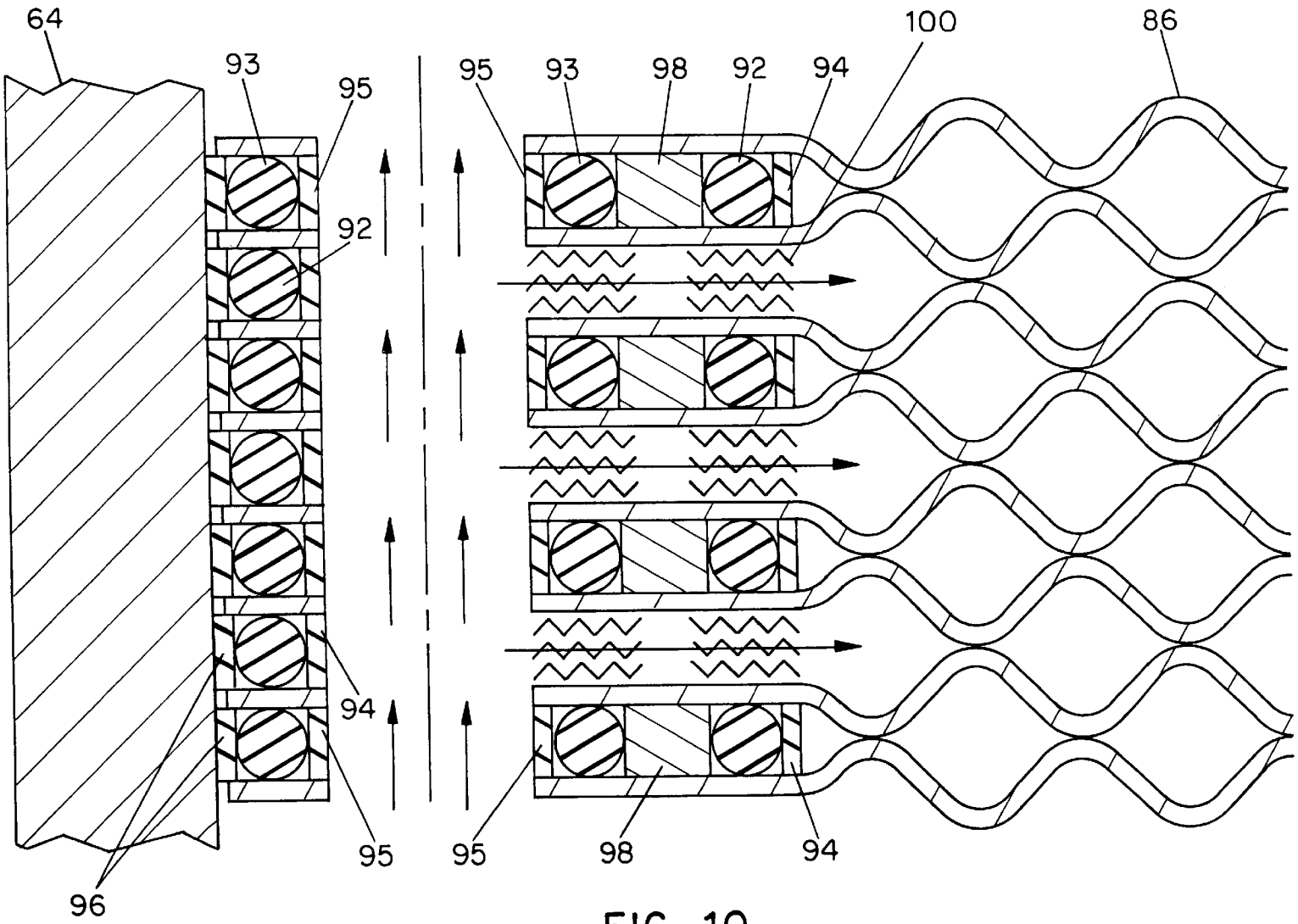
FIG. 10 is a fragmentary cross-sectional view taken on the line X—X of FIG. 8 and looking in the direction of the arrows.

In addition, as shown in FIGS. 8 and 10, the plate pack 62 includes secondary spacer pieces 98 in regions where a main seal 92 is separated from an inner or outer spacer piece 94 or 96. Unlike the inner and outer spacer pieces 94 and 96, which although sufficiently rigid to be retained under compression in their positions between the adjacent plates, are also sufficiently flexible to transmit pressures to the main seal, the secondary spacer pieces 98 are essentially completely rigid in order to maintain the adjacent plates 86 in the desired spaced relation. Preferably, grooves are formed in the plate-engaging surfaces of the secondary spacer pieces and matching grooves are formed in the adjacent surfaces of the plates 86 so that the secondary spacer pieces are held firmly in place even at very high fluid pressures. Moreover, the plate pack 62 includes structural ribbing 100 to maintain adjacent plates separated in regions surrounding port holes where there is no gasketing, the structural ribbing being designed to permit fluid flow from the port holes into the spaces between the adjacent plates.

As is evident from the illustration in FIG. 9, fluid at high pressure in the spaces between the plates 86 of the plate pack applies the high pressure to the inner spacer pieces 94, which are sufficiently resilient to transmit the pressure to the main seals 92, and those seals in turn transmit pressure to the outer spacer pieces 96 which abut the high pressure enclosure 64. As a result of that abutment, the outer spacer pieces are held in position which, in turn, retains the main seals and inner spacer pieces in position despite applied pressures of up to 1200 psi or more.

FIG. 10 illustrates the gasketing arrangement around a passage formed by aligned port holes in the plates 86. In this case, the same gasketing is provided in all of the spaces between the plates 86 in the region between the port holes and the surrounding high pressure enclosure 64 for all of the spaces between the plates 86. Because the fluid passing through the port hole passages must enter into the spaces between alternate plate pairs, however, the gasketing on the interior side of the port hole passages has a different arrangement. For those plate pairs which must be sealed from the fluid passing through the port hole passage, a port hole seal 93 provided with an inner spacer piece 95, surrounds the port hole and the main seal 92, separated from the port hole seal by a secondary space piece 98, is provided with an inner spacer piece 94 and 96 positioned outside the port hole seal. For the spaces between the plates 86 into which fluid must pass from the port hole passage, there is no port hole seal and structured ribbing 100 is provided to support the adjacent plates in spaced relation while permitting the fluid to pass into the spaces between the plates.

Figure 11:
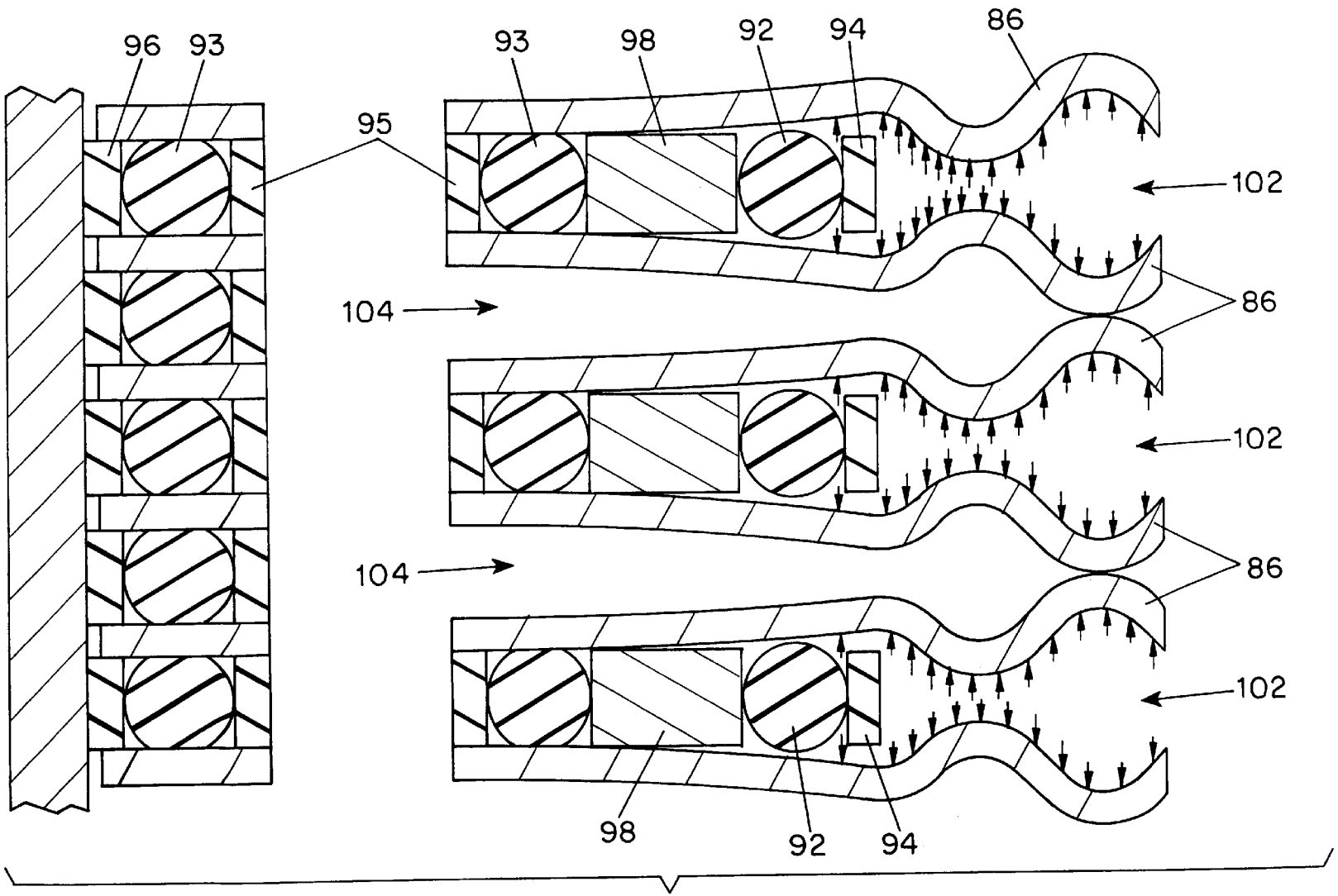
FIG. 11 is a fragmentary cross-sectional view similar to that of FIG. 10 with structural ribbing between adjacent plates removed.
Figure 12A:
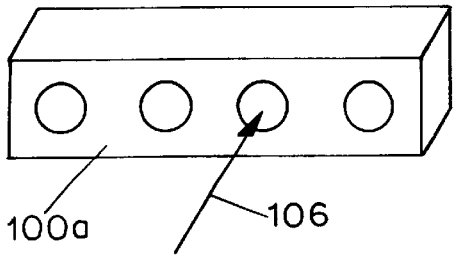
FIGS. 12A–12F are fragmentary perspective views illustrating the arrangement of representative embodiments of structural ribbing for use in a high pressure heat exchanger in accordance with the invention.
Figure 12B:
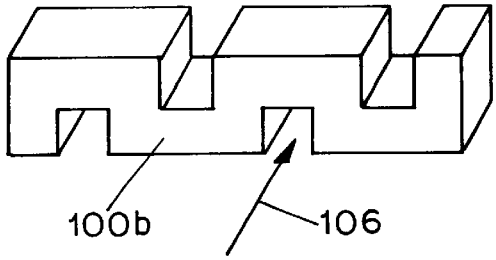
Figure 12C:
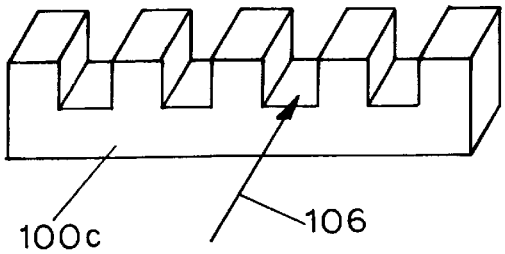
Figure 12D:
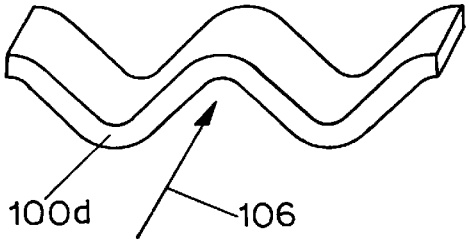
Figure 12E:
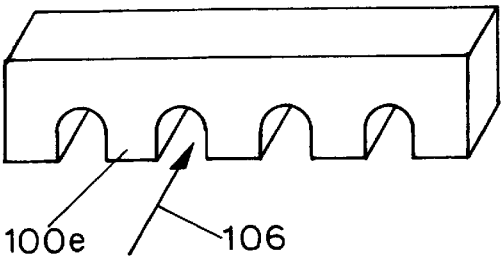
Figure 12F:
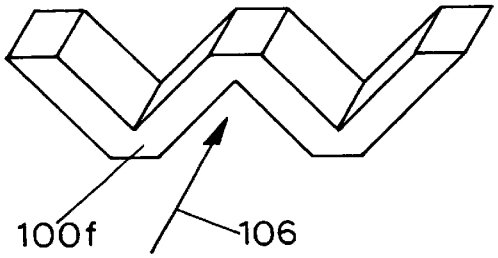

FIG. 11 demonstrates what would happen if the structured ribbing 100 were not provided in the case where the spaces 102 between adjacent plates which are intended to be sealed from the port hole passage have a higher pressure e.g., about 700 psi greater, than the pressure in the spaces 104 between the plates communicating with the port hole passage. As shown in FIG. 11, the higher pressure in the spaces 102 causes the plates 86 adjacent to those spaces to be forced apart, separating them from the inner seals 94 and the main seals 92, leading to leakage from the spaces 102 into the spaces 104. This not only contaminates the fluid which is at lower pressure but also increases the pressure of that fluid and lowers the pressure of the higher pressure fluid in an undesirable manner.

FIGS. 12A–12F illustrate six different structural arrangements 100*a*–100*f*, respectively, which may be used for structural ribbing 100 provided in the manner shown in FIG. 10. In each case, the structural ribbing has sufficient rigidity to assure support for plates disposed on opposite sides of the ribbing while providing a flow path 106 in the direction between the plates.

Figure 13:
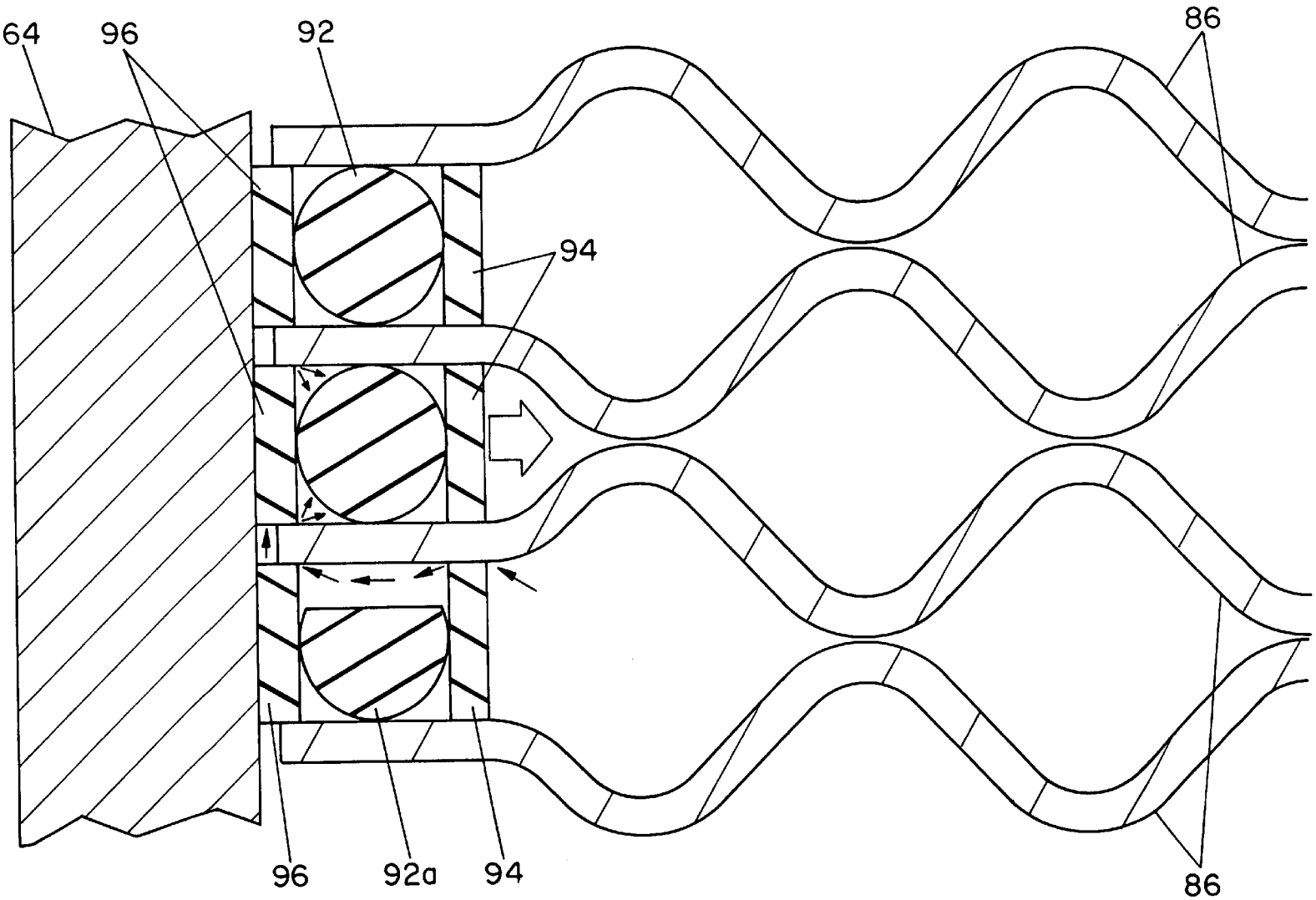
FIG. 13 is an enlarged fragmentary cross-sectional view in the region of the main O-ring seals illustrating failure of an O-ring seal.

With this arrangement the plate pack will not be disabled in the unlikely event of a failure of one of the main seals. As shown in FIG. 13, if one of the main seals 92*a* fails, permitting fluid to pass between that seal and the adjacent plate 86, the higher pressure medium in the region between the adjacent plates will flow past the adjacent inner and outer adjacent spacer pieces 94 and 96 and past the outer spacer piece 96 between the adjacent plates containing a lower pressure fluid medium and will apply pressure inwardly against the main seal 92 between those plates, forcing that main seal against the main seal inner spacer 94. Since that inner spacer, however, is maintained in position between the plates, in part by the plate corrugations in the lower pressure region, it cannot move and consequently the main seal 92 will be maintained in sealing engagement with the adjacent plates, prevent mixing of the higher and lower pressure fluid media. By providing a vent or drain in the high pressure shell, such leakage of fluid media past the main seals can be detected so that a defective main seal can be located and replaced when convenient, while permitting proper operation of the heat exchanger pending replacement of the defective seal.

The main seals 92, inner and outer spacer pieces 94 and 96 and secondary spacer pieces 98 as well as the structural ribbing 100 have the same structures in all of the corresponding spaces between adjacent plates throughout the plate pack. As with the arrangement shown in FIGS. 1–3, the last plate in the pack 86b has no port holes and therefore does not require gasketing on the side between that plate and the compression block 84. On the other hand, the first plate in the pack, having port holes 66*a*, 68*a*, 70*a* and 72*a* which communicate directly with the nozzles 66, 68, 70 and 72, requires a different structure, shown in FIG. 14, to seal the opening surrounding the port holes. In particular, a special spacer piece 110 is interposed between the first plate 86*a* above the pack and the inner end of the hollow shell 64 adjacent to each of the nozzles 66, 68, 70 and 72 to prevent the first plate from warping in the region surrounding the port holes. With this arrangement, the fluid media are precluded from flowing into the space between the first plate 86*a* and the high pressure enclosure. Moreover, the port hole seals surrounding port holes in that plate required only an O-ring 93 and inner and outer spacers 95 and 97 which extend between the first plate 86*a* and a recess 112 adjacent to the inner end of the corresponding nozzle. At the bottom of the recess 112 an insert ring 116 is affixed by a weld 114 to the nozzles 66, 68, 70 and 72. If desired, any other way of fastening the nozzle to the high pressure enclosure which is capable of resisting the high fluid pressures to be applied may be used.

Figure 15:
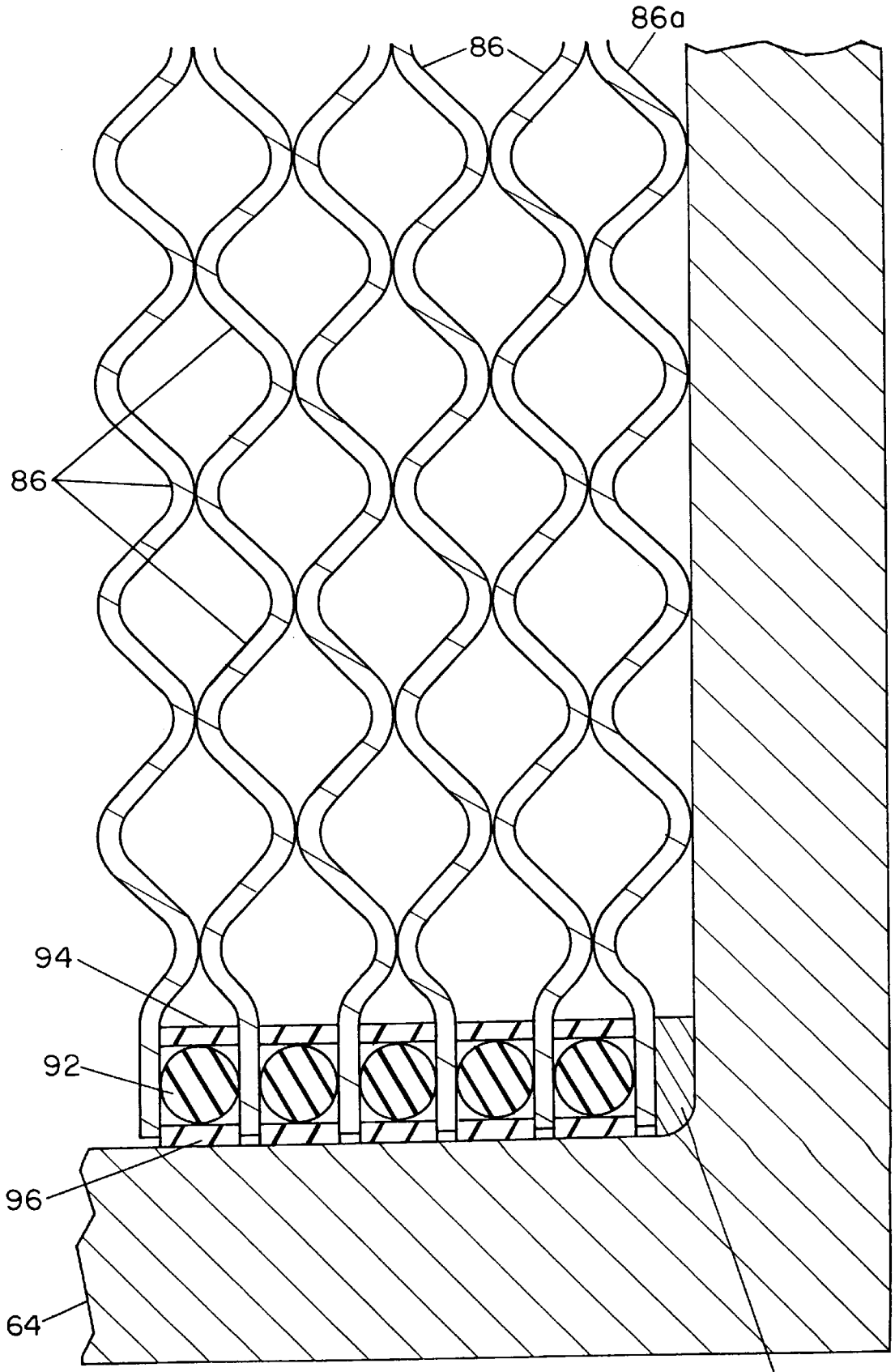
FIG. 15 is an enlarged fragmentary cross-sectional view taken on the line XV—XV of FIG. 6 and looking in the direction of the arrows.
Figure 16:
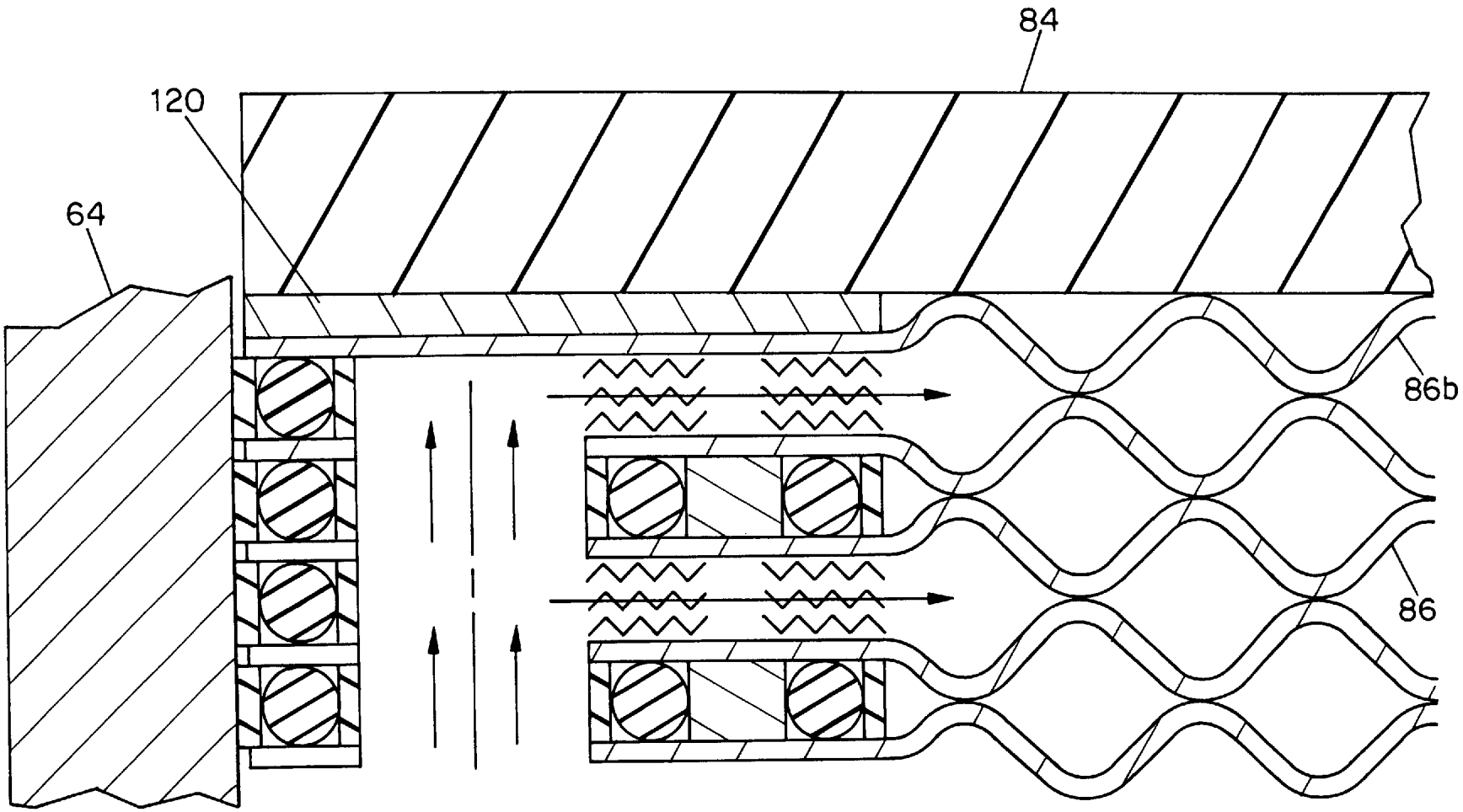
FIG. 16 is an enlarged fragmentary, cross-sectional of the region designed XVI in FIG. 6.
Figure 17:
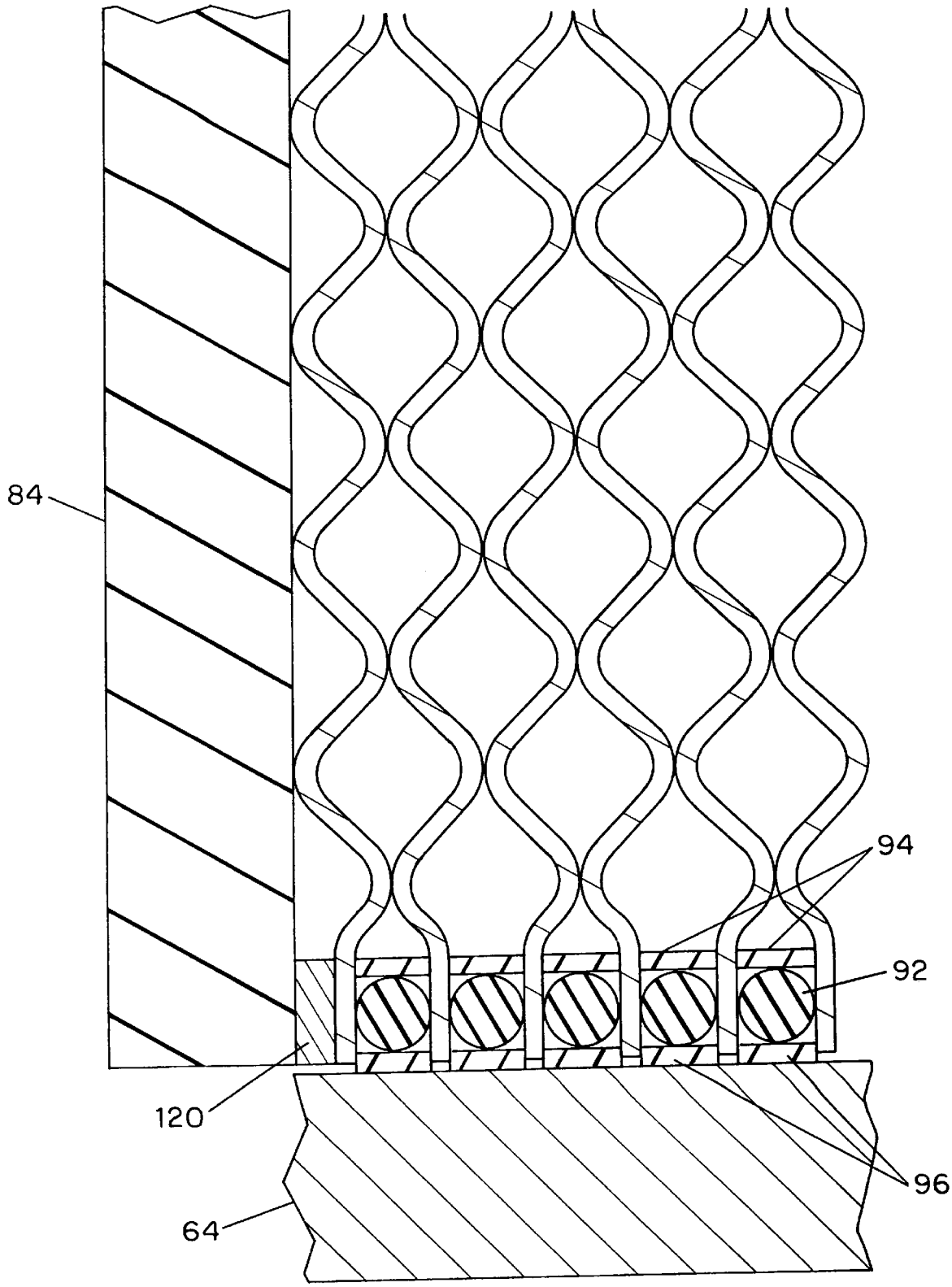
FIG. 17 is an enlarged fragmentary cross-sectional view taken on the line XVII—XVII of FIG. 6 and looking in the direction of the arrows.

FIG. 15 illustrates the arrangement at the first plate 86*a* in the regions away from the port holes. As shown in FIG. 15, the same special spacer 110 is provided between the periphery of the first plate 86*a* in the adjacent surface of the high pressure enclosure to prevent that plate from warping in those regions. At the opposite end of the plate pack, as shown in FIG. 16, the last plate 86*b* adjacent to the compression block 84 is separated from the compression block by another special spacer 120 in the regions having no corrugations such as the regions aligned with the port holes of the other plate in order to prevent warping of the last plate 86*b* in response to high pressures. FIG. 17 shows the configuration of the special spacer piece 120 in a region spaced from the port holes in the other plates. If desired, the special spacer piece 120 may constitute an integral extension of the compression block 84 into the regions of the last plate 86*b* which have no corrugations. Similarly, the special spacer piece 110 at the other end of the plate pack adjacent to the nozzles may constitute inward projections of the inner surface of the high pressure enclosures 64.

Figure 18:
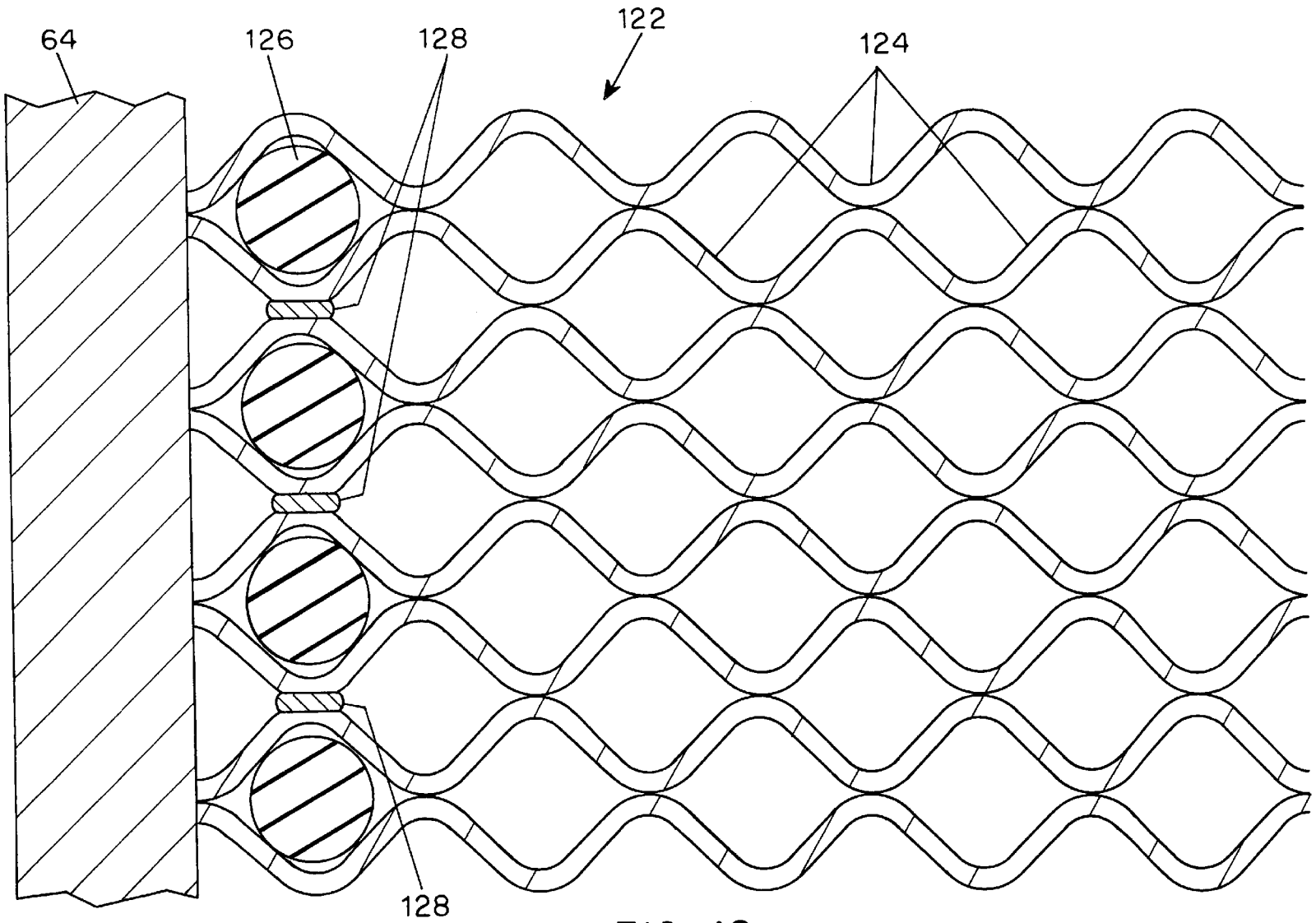
FIG. 18 is a fragmentary cross-sectional view showing an embodiment of the invention utilizing plates having both welded seals and O-ring seals.

In an alternative embodiment 122, shown in FIG. 18, a different high pressure sealing arrangement is provided. In this case, the plate pack includes plates 124 having corrugations extending all the way to the edges of the plates and a captured O-ring seal 126 is compressed between concave corrugations at the edges of every alternate pair of plates, the O-ring gaskets 126 being compressed by about 25% in the same manner described above to assure positive sealing engagement with the adjacent plates. In this case, weld seals 128 are provided between the abutting convex projections of the corrugation on opposite sides of the plates. In this way, a secure high pressure seal is provided without requiring inner and outer main seal spacer pieces, secondary spacer pieces and special spacer pieces at the first and last plates as in the previously described embodiment. Structural ribbing, however, is still required in the regions surrounding port holes through which fluid is intended to flow into the passages between adjacent corrugated plates.

Figure 14:
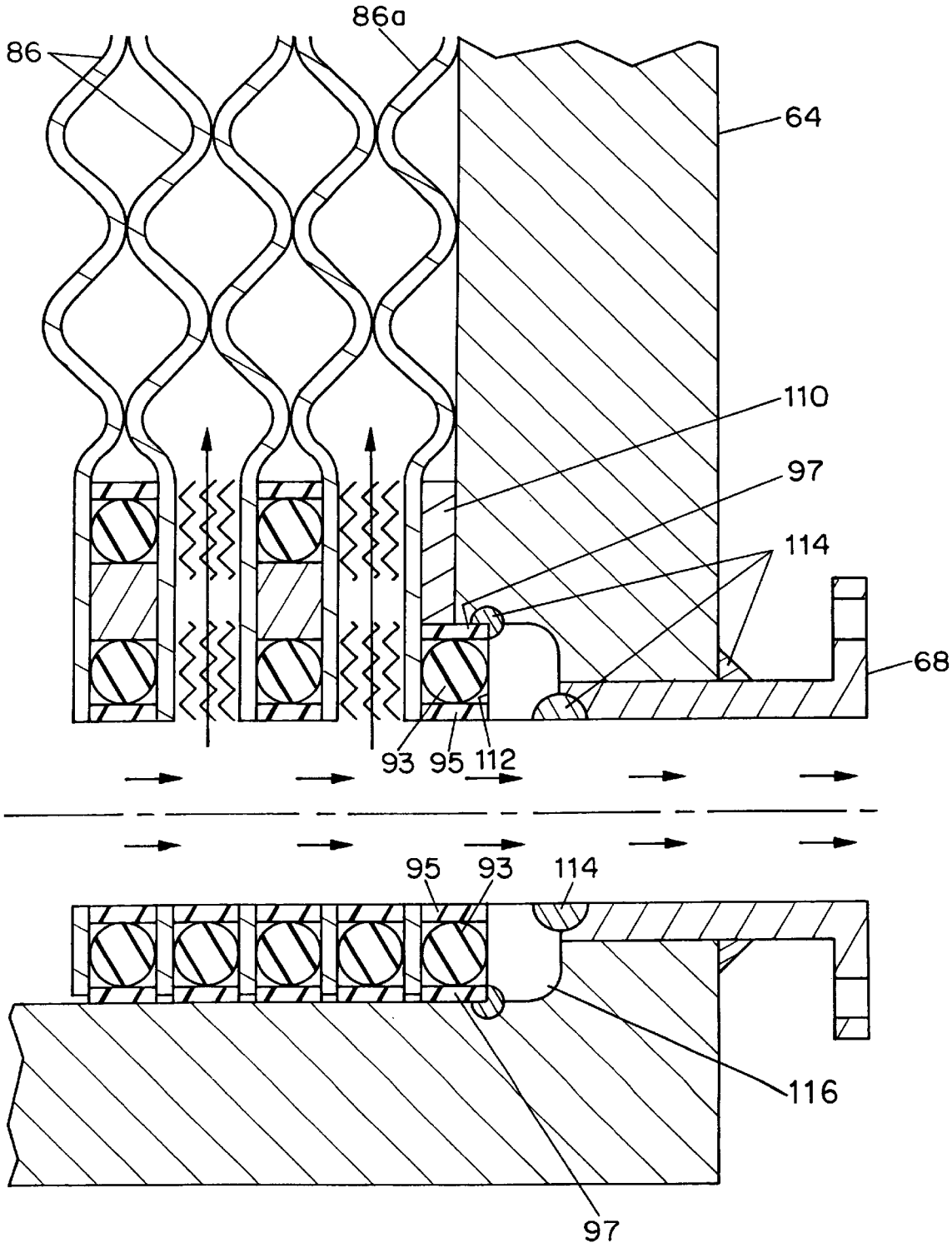
FIG. 14 is an enlarged fragmentary cross-sectional view of the region designated XIV in FIG. 6 showing the arrangement of a nozzle and adjacent plates.

It should be noted that the first plate in the pack of this embodiment does require a O-ring seal at the nozzles such as the O-ring seal 93 in FIG. 14 and the compression block 84 is still needed to compress the captured O-ring seals. In this arrangement, the width of each sealing weld 128 should be at least twice as wide as the thickness of each plate to ensure that the strength of the weld will be greater than that of the plate, thereby allowing the use of very high pressure media. Because the spaces between the plates 124 which are welded together by the welded seals 128 cannot be cleaned directly, this arrangement is utilized when the fluid medium to be passed through spaces between the welded plates is very clean. The high pressure medium can be introduced on either the welded sides of the plates or the sides sealed with O-ring gaskets. Preferably, the welds are formed by contact resistance welding.

Figure 19:
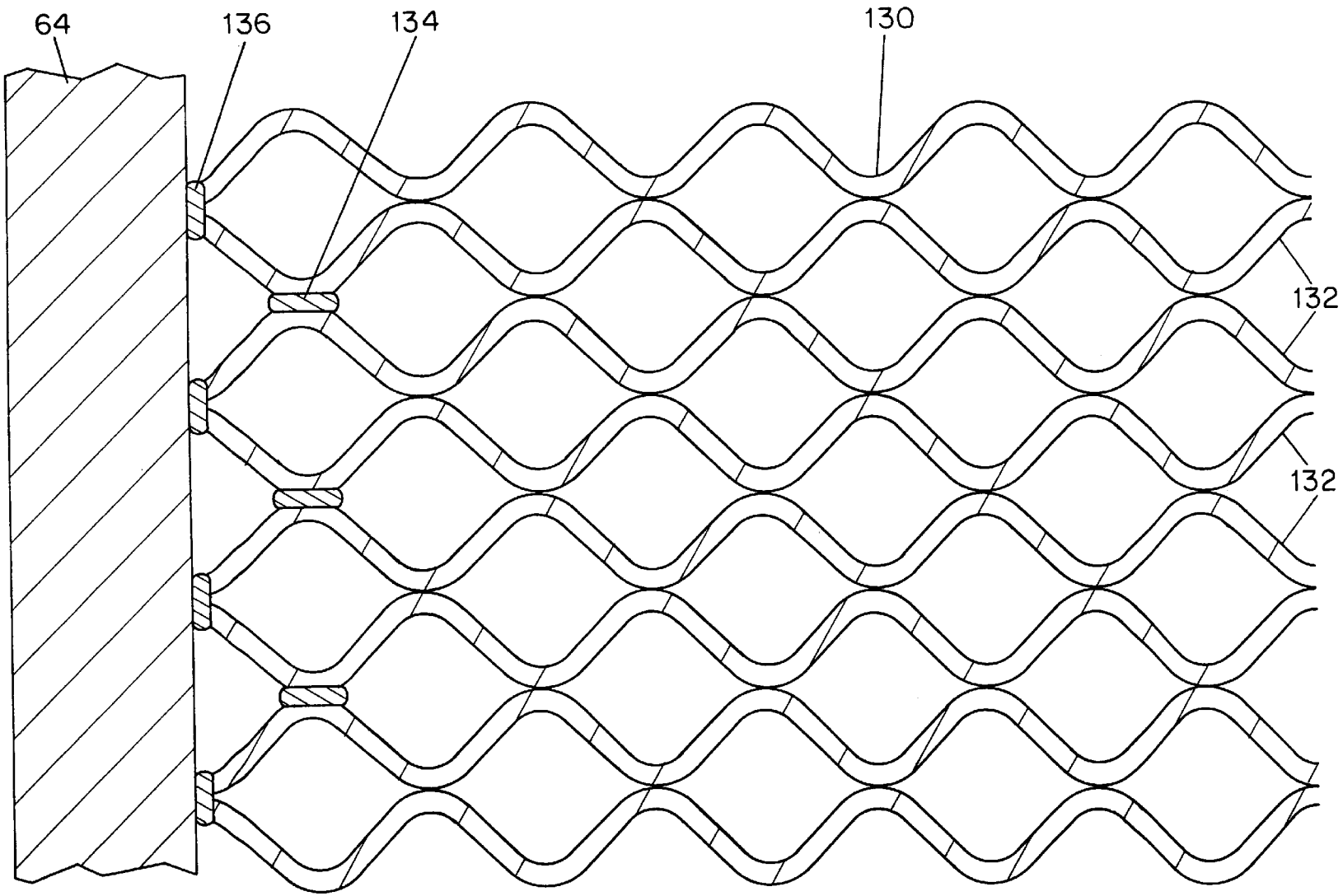
FIG. 19 is a fragmentary cross-sectional view showing an embodiment of a high pressure heat exchanger according to the invention utilizing plates having welded seals throughout.

FIG. 19 illustrates a high pressure corrugated plate pack arrangement 130 which eliminates the need for resilient gaskets at the edges of the plates. As shown in FIG. 19, every alternate pair of adjacent plates 132 of this embodiment have welded seals 134 joining the convex portions of the corrugations adjacent to the periphery of the plate pack and further welded seals 136 joining the abutting edges of the corrugations at the periphery of the plate. This arrangement not only eliminates all of the spacer pieces which were required sealing in the previous embodiments, it also eliminates the need for a compression block, but it may require structural ribbing depending on the plate pack configuration and fluid pressures involved. In addition, O-ring seals at the nozzles and special spacer pieces to prevent warping at the ends of the plates, as shown in FIGS. 14–16, are still required. Since the surfaces between the plates cannot be cleaned, the media used in a plate pack of this type must be free of fouling materials. The welds 134 and 136 may be formed by contact resistance or electron beam methods.

Figure 20:
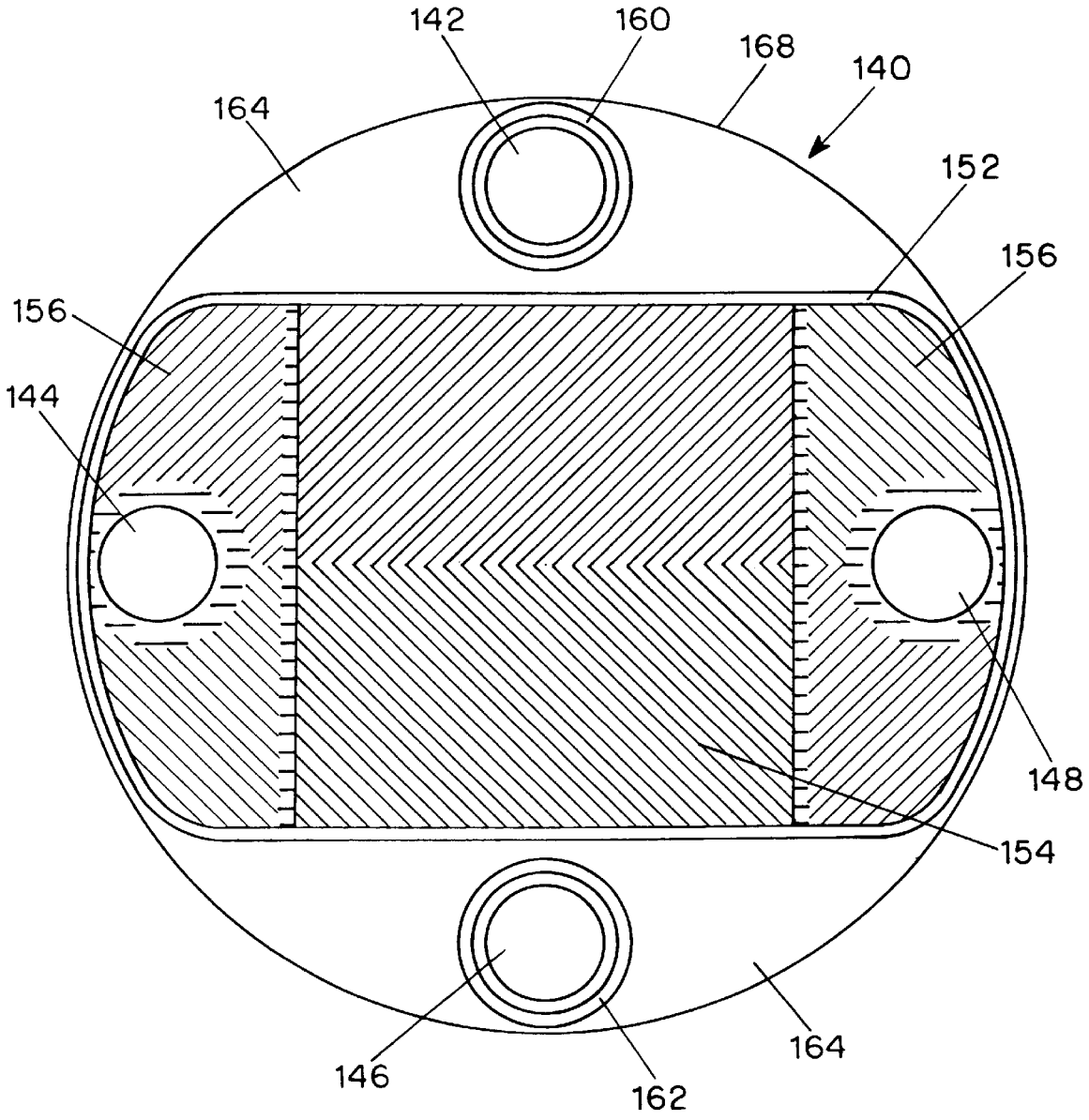
FIG. 20 is a cross-sectional view illustrating another embodiment of a high pressure heat exchanger according to the invention utilizing circular heat transfer plates.

Instead of the generally rectangular plate shapes used in the embodiments described above, a high pressure corrugated plate-type heat exchanger may have circular plates 140 with inlet and outlet ports 142, 144, 146 and 148 spaced at 90° intervals around the periphery of the plate as shown in FIG. 20. In this case, the gasketing includes an inner closed loop gasket 152 enclosing the central corrugated portion 154 having a herringbone corrugation pattern, an inlet port 144 and an outlet port 148 and structured ribbing 156 to distribute the fluids flowing between the ports over the entire region containing the corrugations. The other ports 142 and 146 are surrounded by O-ring gaskets 160 and 162 of the same type described above and secondary spacer pieces 164 are provided to maintain separation of the plates in regions outside the main gasket 152 and within an outer spacer piece 168.

Figure 21:
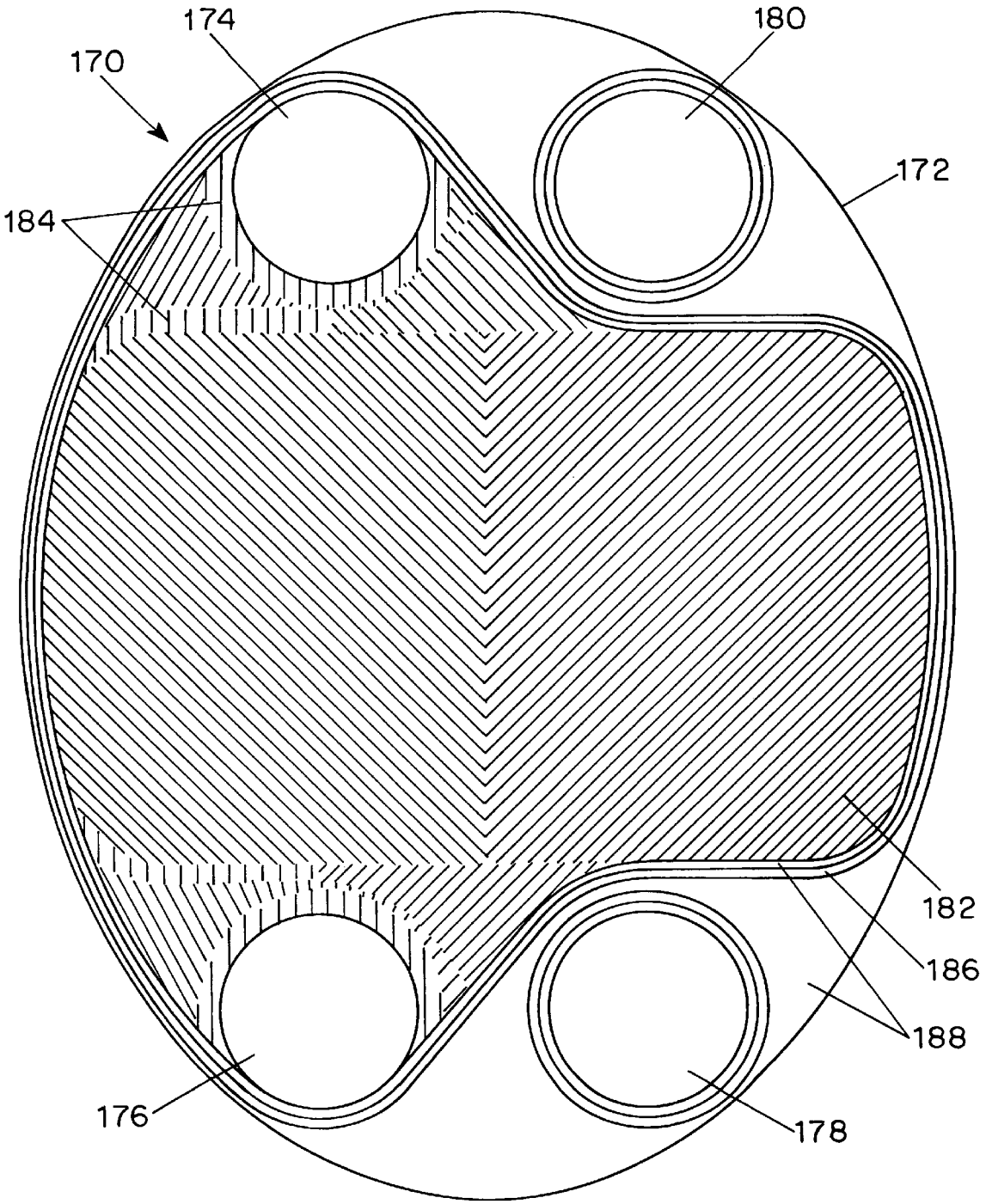
FIG. 21 is a cross-sectional view of a further representative embodiment of a high pressure heat exchanger according to the invention utilizing oval heat transfer plates.

FIG. 21 illustrates a further embodiment 170 consisting of a series of oval plates 172 having inlet and outlet port holes 174, 176, 178 and 180. This embodiment has a central corrugated region 182, structure ribbing 184, gasketing 186 and secondary spacer pieces 188, generally similar to the arrangement shown in FIG. 8.

Figure 22:
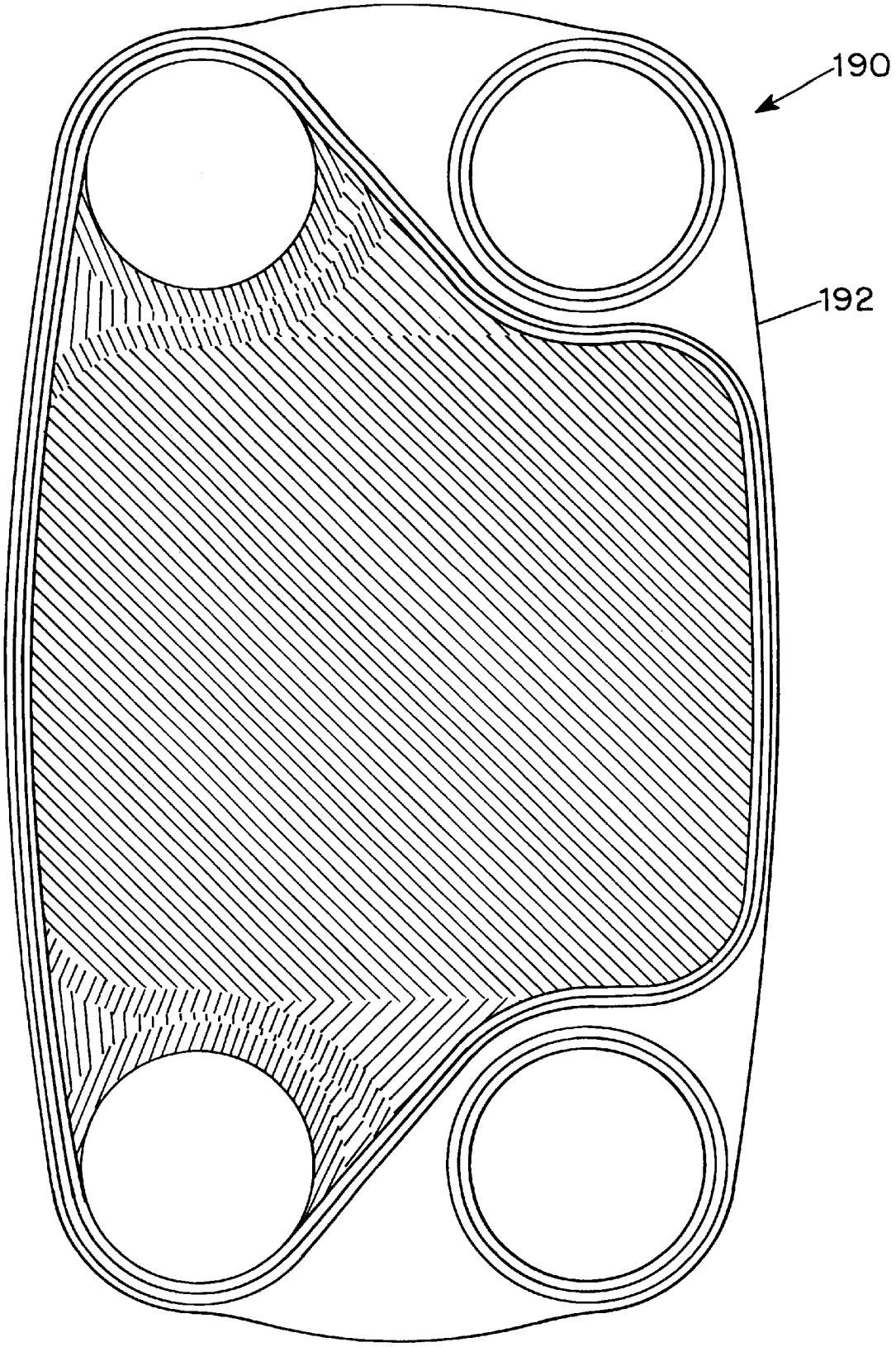
FIG. 22 is a cross-sectional view illustrating still another embodiment of a high pressure heat exchanger according to the invention utilizing heat transfer plates having curved edges.

FIG. 22 shows another embodiment of a corrugated plate high pressure heat exchanger 190 having plates 192 with a configuration similar to that of FIG. 8 but with curved peripheral surfaces. The embodiments of FIGS. 20, 21 and 22 have the advantage that they may be contained within high pressure enclosures of circular or nearly circular cross sections than that of FIG. 6, increasing the strength of high pressure enclosure against lateral deformations of the confining walls.

The high pressure enclosures used to contain the plate packs in accordance with the present invention may be made of any material compatible with the fluid media which are being used and capable of withstanding the pressures to be applied. The maximum pressure to which a high pressure heat exchanger can be subjected is a function of the size of the unit. For example, an application in which only relatively small plates are required, such as six inches by twelve to eighteen inches, and in which the size of the flow passages and structural sections of the high pressure enclosure are relatively small, permits very high pressures such as 2500 psi and possibly higher to be used since the plate thickness and enclosure wall thickness can be increased easily to accommodate high mechanical loads. On the other hand, in an application in which relatively large plates are required, such as 48 inches by 120 inches, the size of the flow passages in the structural sections may have to be up to four times as large and, for reasonable plate and enclosure wall thicknesses, such a large unit may withstand pressures up to only about 1200 psi. Moreover, since the heat transfer plates may crack during the embossing or pressing process by which the corrugations and other structural features are imparted if the plate is too thick, this may also impose an upper limit on the fluid pressures to be applied. Furthermore, as the plate thickness increases, the heat transfer capability of the plate is reduce since more thermal resistance needs to be overcome. Consequently, increasing the thickness of the plate to withstand higher pressure must be balanced against the reduction of operating functions of the heat exchanger.

Although the invention has been described herein with reference to specific embodiments, many modifications and variations therein will readily occur to those skilled in the art. Accordingly, all such variations and modifications are included within the intended scope of the invention.

I claim:

1. A high pressure corrugated plate-type heat exchanger comprising:

a plurality of corrugated plates forming a plate pack providing passages for two fluid media to pass between alternate pairs of adjacent plates respectively in heat exchange relation therewith;

a plurality of high pressure seals between adjacent plates and peripheral seals along edges of adjacent plates to prevent fluid media from escaping from spaces between adjacent plates while permitting fluid to pass into the spaces between adjacent plates from corresponding inlet and outlet passages therethrough; and a high pressure shell enclosure surrounding the plate pack and engaging the edges and peripheral seals thereof to oppose the pressures of fluid media passing therethrough.

2. A high pressure corrugated plate-type heat exchanger according to claim 1 including structural ribbing disposed between adjacent plates in regions surrounding port holes from which fluid is permitted to pass into the space between adjacent plates for maintaining separation of the plates in response to pressures in the spaces outside the adjacent plates.

3. A high pressure corrugated plate-type heat exchanger according to claim 1 wherein the seals between adjacent plates comprise sealing welds between the plates to prevent escape of high pressure fluids from the spaces between the plates.

4. A high pressure corrugated plate-type heat exchanger according to claim 1 wherein the seals between adjacent plates comprise resilient gasket material captured in spaces between adjacent plates.

5. A high pressure corrugated plate-type heat exchanger according to claim 4 wherein the resilient gasket material is captured between concave corrugation portions of adjacent plates.

6. A high pressure corrugated plate-type heat exchanger according to claim 4 wherein the resilient gasket material is captured between inner and outer spacer pieces adjacent to the resilient gasket material which are retained between the adjacent plates by pressure applied to the plates.

7. A high pressure corrugated plate-type heat exchanger according to claim 6 including a secondary spacer piece disposed between the resilient gasket material and an outer spacer piece.

8. A high pressure corrugated plate-type heat exchanger according to claim 4 including a resilient compression block disposed between the plate pack and the high pressure enclosure and arranged to apply pressure to the plates of the plate pack and compress resilient gasket material in spaces between the plates of the plate pack.

9. A high pressure corrugated plate-type heat exchanger according to claim 1 wherein the high pressure enclosure includes a hollow shell which receives the plate pack and an end plate and a pressure applying means for applying pressure to the end plate for transmission to the plates of the plate pack.

10. A high pressure corrugated plate-type heat exchanger according to claim 9 including a resilient compression block disposed between the end plate and the plate pack for transmitting pressure from the end plate to the plate pack.

11. A high pressure corrugated plate-type heat exchanger according to claim 1 wherein each of the plates of the plate pack has a generally rectangular configuration.

12. A high pressure corrugated plate-type heat exchanger according to claim 11 wherein each plate of the plate pack has curved edges.

13. A high pressure corrugated plate-type heat exchanger according to claim 1 wherein each of the plates of the plate pack has a circular periphery.

14. A high pressure corrugated plate-type heat exchanger according to claim 1 wherein each of the plates of the plate pack has an oval peripheral configuration.

* * * * *